US011289029B1

(12) United States Patent
Sung et al.

(10) Patent No.: US 11,289,029 B1
(45) Date of Patent: Mar. 29, 2022

(54) ORGANIC LIGHT EMITTING DIODE DISPLAY DEVICE, AND METHOD OF OPERATING AN ORGANIC LIGHT EMITTING DIODE DISPLAY DEVICE

(71) Applicant: Samsung Display Co., Ltd., Yongin-Si (KR)

(72) Inventors: Jeongmin Sung, Seoul (KR); Woo-Chul Kim, Seoul (KR); Ok-Kwon Shin, Seoul (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/307,961

(22) Filed: May 4, 2021

(30) Foreign Application Priority Data

Nov. 3, 2020 (KR) ..... 10-2020-0145576

(51) Int. Cl.
*G09G 3/3291* (2016.01)

(52) U.S. Cl.
CPC ..... *G09G 3/3291* (2013.01); *G09G 2320/0276* (2013.01); *G09G 2320/0673* (2013.01)

(58) Field of Classification Search
CPC ..... G09G 3/3291; G09G 3/3225; G09G 3/3258
See application file for complete search history.

(56) References Cited

U.S. PATENT DOCUMENTS

2017/0004766 A1* 1/2017 Cho ..... G09G 3/3233
2018/0342202 A1 11/2018 Sung et al.

FOREIGN PATENT DOCUMENTS

KR 1020180056488 A 5/2018
KR 1020180129019 A 12/2018
KR 1020190098296 A 8/2019

* cited by examiner

*Primary Examiner* — Sardis F Azongha
(74) *Attorney, Agent, or Firm* — Innovation Counsel LLP

(57) ABSTRACT

An organic light emitting diode (OLED) display device includes a display panel including a plurality of pixels, and a panel driver configured to drive the display panel. The panel driver drives the display panel at a frame frequency corresponding to 1/N of an emission frequency such that each frame period corresponds to an N multiple of an emission period, where N is an integer greater than 1. The panel driver gradually decreases the frame frequency of the display panel in a case where input image data are not received and gradually increases the frame frequency of the display panel in a case where the input image data are received.

20 Claims, 15 Drawing Sheets

FIG. 3

210

| PARAMETER RANGE SETTING | PARAMETER SET | | | | |
|---|---|---|---|---|---|
| | GAMMA SET | DECREASING STEP PARAMETER | INCREASING STEP PARAMETER | DECREASING HOLD FRAME PARAMETER | INCREASING HOLD FRAME PARAMETER |
| P_RANGE_LIMIT1 | GAMMA_SET1 | P_STEP_D1 | P_STEP_I1 | P_HOLD_FR_D1 | P_HOLD_FR_I1 (P_SET1) |
| P_RANGE_LIMIT2 | GAMMA_SET2 | P_STEP_D2 | P_STEP_I2 | P_HOLD_FR_D2 | P_HOLD_FR_I2 (P_SET2) |
| P_RANGE_LIMIT3 | GAMMA_SET3 | P_STEP_D3 | P_STEP_I3 | P_HOLD_FR_D3 | P_HOLD_FR_I3 (P_SET3) |
| X | GAMMA_SET4 | P_STEP_D4 | P_STEP_I4 | P_HOLD_FR_D4 | P_HOLD_FR_I4 (P_SET4) |

230

| | | | |
|---|---|---|---|
| P_GAME_OP | P_FR_TH | P_ACT_CYC | P_FR_MIN | P_FR_MAX |

FIG. 6

| PARAMETER RANGE SETTING | | PARAMETER SET | | | | | | | | | | |
|---|---|---|---|---|---|---|---|---|---|---|---|---|
| | | GAMMA SET | DECREASING STEP PARAMETER | | INCREASING STEP PARAMETER | | DECREASING HOLD FRAME PARAMETER | | INCREASING HOLD FRAME PARAMETER | | |
| P_RANGE_LIMIT1 | 0 | GAMMA_SET1 | P_STEP_D1 | 1 | P_STEP_I1 | 2 | P_HOLD_FR_D1 | 1 | P_HOLD_FR_I1 | 1 | P_SET1 |
| P_RANGE_LIMIT2 | 1 | GAMMA_SET2 | P_STEP_D2 | 1 | P_STEP_I2 | 3 | P_HOLD_FR_D2 | 1 | P_HOLD_FR_I2 | 1 | P_SET2 |
| P_RANGE_LIMIT3 | 2 | GAMMA_SET3 | P_STEP_D3 | 1 | P_STEP_I3 | 5 | P_HOLD_FR_D3 | 1 | P_HOLD_FR_I3 | 1 | P_SET3 |
| X | | GAMMA_SET4 | P_STEP_D4 | 1 | P_STEP_I4 | 4 | P_HOLD_FR_D4 | 3 | P_HOLD_FR_I4 | 1 | P_SET4 |

| P_GAME_OP | P_FR_TH | P_ACT_CYC | P_FR_MIN | P_FR_MAX |
|---|---|---|---|---|
| 0 | 6 | 4 | 0 | 3 |

FIG. 8

| PARAMETER RANGE SETTING | | PARAMETER SET | | | | | | | | | | |
|---|---|---|---|---|---|---|---|---|---|---|---|---|
| | | GAMMA SET | DECREASING STEP PARAMETER | | INCREASING STEP PARAMETER | | DECREASING HOLD FRAME PARAMETER | | INCREASING HOLD FRAME PARAMETER | | |
| P_RANGE_LIMIT1 | 1 | GAMMA_SET1 | P_STEP_D1 | 2 | P_STEP_I1 | 2 | P_HOLD_FR_D1 | 1 | P_HOLD_FR_I1 | 1 | P_SET1 |
| P_RANGE_LIMIT2 | 3 | GAMMA_SET2 | P_STEP_D2 | 4 | P_STEP_I2 | 3 | P_HOLD_FR_D2 | 2 | P_HOLD_FR_I2 | 1 | P_SET2 |
| P_RANGE_LIMIT3 | 7 | GAMMA_SET3 | P_STEP_D3 | 2 | P_STEP_I3 | 5 | P_HOLD_FR_D3 | 1 | P_HOLD_FR_I3 | 1 | P_SET3 |
| X | | GAMMA_SET4 | P_STEP_D4 | 3 | P_STEP_I4 | 4 | P_HOLD_FR_D4 | 3 | P_HOLD_FR_I4 | 1 | P_SET4 |

| P_GAME_OP | P_FR_TH | P_ACT_CYC | P_FR_MIN | P_FR_MAX |
|---|---|---|---|---|
| 0 | 8 | 4 | 0 | 11 |

FIG. 10

| PARAMETER RANGE SETTING | | PARAMETER SET | | | | | | | | | | |
|---|---|---|---|---|---|---|---|---|---|---|---|---|
| | | GAMMA SET | DECREASING STEP PARAMETER | | INCREASING STEP PARAMETER | | DECREASING HOLD FRAME PARAMETER | | INCREASING HOLD FRAME PARAMETER | | |
| P_RANGE_LIMIT1 | 1 | GAMMA_SET1 | P_STEP_D1 | 2 | P_STEP_I1 | 2 | P_HOLD_FR_D1 | 1 | P_HOLD_FR_I1 | 1 | P_SET1 |
| P_RANGE_LIMIT2 | 3 | GAMMA_SET2 | P_STEP_D2 | 4 | P_STEP_I2 | 3 | P_HOLD_FR_D2 | 2 | P_HOLD_FR_I2 | 1 | P_SET2 |
| P_RANGE_LIMIT3 | 7 | GAMMA_SET3 | P_STEP_D3 | 2 | P_STEP_I3 | 5 | P_HOLD_FR_D3 | 1 | P_HOLD_FR_I3 | 1 | P_SET3 |
| X | | GAMMA_SET4 | P_STEP_D4 | 3 | P_STEP_I4 | 4 | P_HOLD_FR_D4 | 3 | P_HOLD_FR_I4 | 1 | P_SET4 |

| P_GAME_OP | P_FR_TH | P_ACT_CYC | P_FR_MIN | P_FR_MAX |
|---|---|---|---|---|
| 0 | 6 | 4 | 0 | 11 |

FIG. 12

| PARAMETER RANGE SETTING | | PARAMETER SET | | | | | | | | | | |
|---|---|---|---|---|---|---|---|---|---|---|---|---|
| | | GAMMA SET | DECREASING STEP PARAMETER | | INCREASING STEP PARAMETER | | DECREASING HOLD FRAME PARAMETER | | INCREASING HOLD FRAME PARAMETER | | |
| P_RANGE_LIMIT1 | 1 | GAMMA_SET1 | P_STEP_D1 | 1 | P_STEP_I1 | 17 | P_HOLD_FR_D1 | 1 | P_HOLD_FR_I1 | 1 | P_SET1 |
| P_RANGE_LIMIT2 | 7 | GAMMA_SET2 | P_STEP_D2 | 4 | P_STEP_I2 | 17 | P_HOLD_FR_D2 | 2 | P_HOLD_FR_I2 | 1 | P_SET2 |
| P_RANGE_LIMIT3 | 10 | GAMMA_SET3 | P_STEP_D3 | 2 | P_STEP_I3 | 17 | P_HOLD_FR_D3 | 1 | P_HOLD_FR_I3 | 1 | P_SET3 |
| X | | GAMMA_SET4 | P_STEP_D4 | 5 | P_STEP_I4 | 17 | P_HOLD_FR_D4 | 3 | P_HOLD_FR_I4 | 1 | P_SET4 |

| P_GAME_OP | P_FR_TH | P_ACT_CYC | P_FR_MIN | P_FR_MAX |
|---|---|---|---|---|
| 1 | 16 | 4 | 1 | 16 |

ORGANIC LIGHT EMITTING DIODE DISPLAY DEVICE, AND METHOD OF OPERATING AN ORGANIC LIGHT EMITTING DIODE DISPLAY DEVICE

CROSS-REFERENCE TO RELATED APPLICATION(S)

This application claims priority under 35 USC § 119 to Korean Patent Application No. 10-2020-0145576, filed on Nov. 3, 2020 in the Korean Intellectual Property Office (KIPO), the content of which is incorporated by reference herein in its entirety.

BACKGROUND

1. Field

The field of the present disclosure is display devices and, more particularly, organic light emitting diode (OLED) display devices and methods of operating the OLED display devices.

2. Discussion of the Background

A display device, such as an organic light emitting diode (OLED) display device, may generally display an image at a constant frame rate (or a constant frame frequency) of about 60 Hz or more. However, a frame rate of rendering by a host processor (e.g., an application processor (AP), a graphic processing unit (GPU) or a graphic card) providing frame data to the OLED display device may be different from a frame rate (or a frame frequency) of the OLED display device. In particular, when the host processor provides the OLED display device with frame data for a game image (gaming image) that requires complicated rendering, the frame rate mismatch may be intensified, and a tearing phenomenon may occur where a boundary line is caused by the frame rate mismatch in an image of the OLED display device.

To prevent or reduce the tearing phenomenon, an adaptive sync mode (e.g., a Free-Sync mode, a G-Sync mode, a Q-Sync mode, etc.) has been developed in which a host processor provides frame data to an OLED display device with a variable frame rate (or a variable frame frequency) by changing a time length of a blank period in each frame period. The OLED display device supporting the adaptive sync mode may display an image in synchronization with the variable frame rate, thereby reducing or preventing the tearing phenomenon.

However, in a case where the adaptive sync mode is applied to an OLED display device employing an impulsive driving method that allows each OLED to emit light and not to emit light periodically, an emission duty ratio may differ for each frame period, a flicker may occur, and a luminance change caused by a change of a frame frequency may be perceived by a user.

SUMMARY

Some embodiments provide an organic light emitting diode (OLED) display device capable of improving an image quality in an adaptive sync mode.

Some embodiments provide a method of operating an OLED display device capable of improving an image quality in an adaptive sync mode.

According to embodiments, there is provided an OLED including a display panel including a plurality of pixels, and a panel driver configured to drive the display panel. The panel driver drives the display panel at a frame frequency corresponding to 1/N of an emission frequency such that each frame period corresponds to an N multiple of an emission period, where N is an integer greater than 1, gradually decreases the frame frequency of the display panel in a case where input image data are not received, and gradually increases the frame frequency of the display panel in a case where the input image data are received.

In embodiments, the panel driver may gradually increase a number of the emission periods within the frame period in the case where the input image data are not received, and may gradually decrease a number of the emission periods within the frame period in the case where the input image data are received.

In embodiments, the panel driver may increase a planned frame time of a next frame period by M emission periods than a planned frame time of a current frame period in the case where the input image data are not received during the planned frame time of the current frame period, where M is an integer greater than 0. The panel driver may decrease the planned frame time of the next frame period by K emission periods than the planned frame time of the current frame period in the case where the input image data are received during the planned frame time of the current frame period, where K is an integer greater than 0.

In embodiments, when the frame frequency of the display panel is changed, the panel driver may change a gamma set for generating data voltages provided to the plurality of pixels.

In embodiments, the panel driver may determine a planned frame time of a next frame period based on a planned frame time of a current frame period and whether the input image data are received in the current frame period. The panel driver may determine a parameter set in the next frame period based on the planned frame time of the next frame period.

In embodiments, the panel driver may store a plurality of parameter sets respectively corresponding to a plurality of frame time ranges. Each of the plurality of parameter sets may include a gamma set representing gamma reference voltages for generating data voltages provided to the plurality of pixels, a decreasing step parameter representing a number of the emission periods that is increased when the frame frequency is decreased, an increasing step parameter representing a number of the emission periods that is decreased when the frame frequency is increased, a decreasing hold frame parameter representing a number of the frame periods having a decreased frame frequency when the frame frequency is decreased, and an increasing hold frame parameter representing a number of the frame periods having an increased frame frequency when the frame frequency is increased.

In embodiments, in the case where the input image data are not received in the current frame period, the current frame period may be finished when a time of the current frame period becomes the planned frame time of the current frame period, the planned frame time of the next frame period may be calculated by adding a product of the emission period and the decreasing step parameter in the current frame period to the planned frame time of the current frame period, and the parameter set of the next frame period may be determined as one of the plurality of parameter sets corresponding to the planned frame time of the next frame period.

In embodiments, the panel driver may further store a maximum frame parameter corresponding to a maximum frame time. The planned frame time of the next frame period may be determined as the maximum frame time in a case where the product of the emission period and the decreasing step parameter in the current frame period added to the planned frame time of the current frame period is greater than the maximum frame time.

In embodiments, in the case where the input image data are received in the current frame period, a finished frame time of the current frame period may be calculated by subtracting a product of the emission period and the increasing step parameter in the current frame period from the planned frame time of the current frame period, the current frame period may be finished when a time of the current frame period becomes the finished frame time of the current frame period, the planned frame time of the next frame period may be determined as the finished frame time of the current frame period, and the parameter set of the next frame period may be determined as one of the plurality of parameter sets corresponding to the planned frame time of the next frame period.

In embodiments, the panel driver may further store a minimum frame parameter corresponding to a minimum frame time. The planned frame time of the next frame period may be determined as the minimum frame time in a case where the product of the emission period and the increasing step parameter in the current frame period subtracted from the planned frame time of the current frame period is less than the minimum frame time.

In embodiments, the panel driver may further store a threshold frame parameter corresponding to a frame time threshold value. The planned frame time of the next frame period may be determined as the minimum frame time in a case where the product of the emission period and the increasing step parameter in the current frame period subtracted from the planned frame time of the current frame period is greater than the frame time threshold value.

In embodiments, the panel driver may store a gaming mode parameter representing whether an operation mode is a gaming mode, and a maximum frame parameter corresponding to a maximum frame time. In a case where the gaming mode parameter indicates the gaming mode, a planned frame time of each frame period may be determined as the maximum frame time, a current frame period may be finished when the input image data are received, and a parameter set of a next frame period may be determined based on a finished frame time of the current frame period.

According to embodiments, there is provided a method of operating an OLED display device. In the method, a display panel of the OLED display device is driven at a frame frequency corresponding to 1/N of an emission frequency such that each frame period corresponds to an N multiple of an emission period, where N is an integer greater than 1, the frame frequency of the display panel is gradually decreased in a case where input image data are not received, and the frame frequency of the display panel is gradually increased in a case where the input image data are received.

In embodiments, to gradually decrease the frame frequency of the display panel, a number of the emission periods within the frame period may be gradually increased in the case where the input image data are not received. To gradually increase the frame frequency of the display panel, a number of the emission periods within the frame period may be gradually decreased in the case where the input image data are received.

In embodiments, to gradually decrease the frame frequency of the display panel, a planned frame time of a next frame period may be increased by M emission periods than a planned frame time of a current frame period in the case where the input image data are not received during the planned frame time of the current frame period, where M is an integer greater than 0. To gradually increase the frame frequency of the display panel, the planned frame time of the next frame period may be decreased by K emission periods than the planned frame time of the current frame period in the case where the input image data are received during the planned frame time of the current frame period, where K is an integer greater than 0.

In embodiments, a gamma set for generating data voltages provided to a plurality of pixels of the display panel may be changed when the frame frequency of the display panel is changed.

In embodiments, to gradually decrease the frame frequency of the display panel, a current frame period may be finished when a time of the current frame period becomes a planned frame time of the current frame period in the case where the input image data are not received in the current frame period, a planned frame time of a next frame period may be calculated by adding a product of the emission period and a decreasing step parameter in the current frame period to the planned frame time of the current frame period, and a parameter set of the next frame period may be determined based on the planned frame time of the next frame period.

In embodiments, to gradually increase the frame frequency of the display panel, a finished frame time of a current frame period may be calculated by subtracting a product of the emission period and an increasing step parameter in the current frame period from a planned frame time of the current frame period in the case where the input image data are received in the current frame period, the current frame period may be finished when a time of the current frame period becomes the finished frame time of the current frame period, a planned frame time of a next frame period may be determined as the finished frame time of the current frame period, and a parameter set of the next frame period may be determined based on the planned frame time of the next frame period.

In embodiments, to determine the planned frame time of the next frame period, the planned frame time of the next frame period may be determined as the finished frame time of the current frame period in a case where the product of the emission period and the increasing step parameter in the current frame period subtracted from the planned frame time of the current frame period is less than or equal to a frame time threshold value, and the planned frame time of the next frame period may be determined as a minimum frame time in a case where the product of the emission period and the increasing step parameter in the current frame period subtracted from the planned frame time of the current frame period is greater than the frame time threshold value.

In embodiments, whether a gaming mode parameter indicates a gaming mode may be determined, a planned frame time of each frame period may be determined as a maximum frame time in a case where the gaming mode parameter indicates the gaming mode, a current frame period may be finished when the input image data are received, and a parameter set of a next frame period may be determined based on a finished frame time of the current frame period.

As described above, in an OLED display device and a method of operating the OLED display device according to embodiments, a display panel may be driven at a frame frequency corresponding to 1/N of an emission frequency such that each frame period corresponds to an N multiple of an emission period, where N is an integer greater than 1. Accordingly, even if input image data are received at a variable frame rate (or a variable frame frequency), an emission duty ratio in each frame period may be maintained as substantially constant, and a flicker may be prevented from occurring.

Further, in an OLED display device and a method of operating the OLED display device according to embodiments, a frame frequency of a display panel may be gradually decreased in a case where input image data are not received, and the frame frequency of the display panel may be gradually increased in a case where the input image data are received. Accordingly, even if a frame rate (or a frame frequency) of the input image data is rapidly changed, a luminance change caused by the change of the frame frequency may not be perceived by a user.

BRIEF DESCRIPTION OF THE DRAWINGS

Illustrative, non-limiting embodiments will be more clearly understood from the following detailed description in conjunction with the accompanying drawings.

FIG. 3 is a diagram for describing an example of parameter sets stored in an OLED display device according to embodiments.

FIG. 6 is a diagram illustrating an example of parameter sets.

FIG. 8 is a diagram illustrating another example of parameter sets.

FIG. 10 is a diagram illustrating still another example of parameter sets.

FIG. 12 is a diagram illustrating still another example of parameter sets.

DETAILED DESCRIPTION OF THE EMBODIMENTS

Hereinafter, embodiments of the present inventive concept will be explained in detail with reference to the accompanying drawings.

Figure 1:
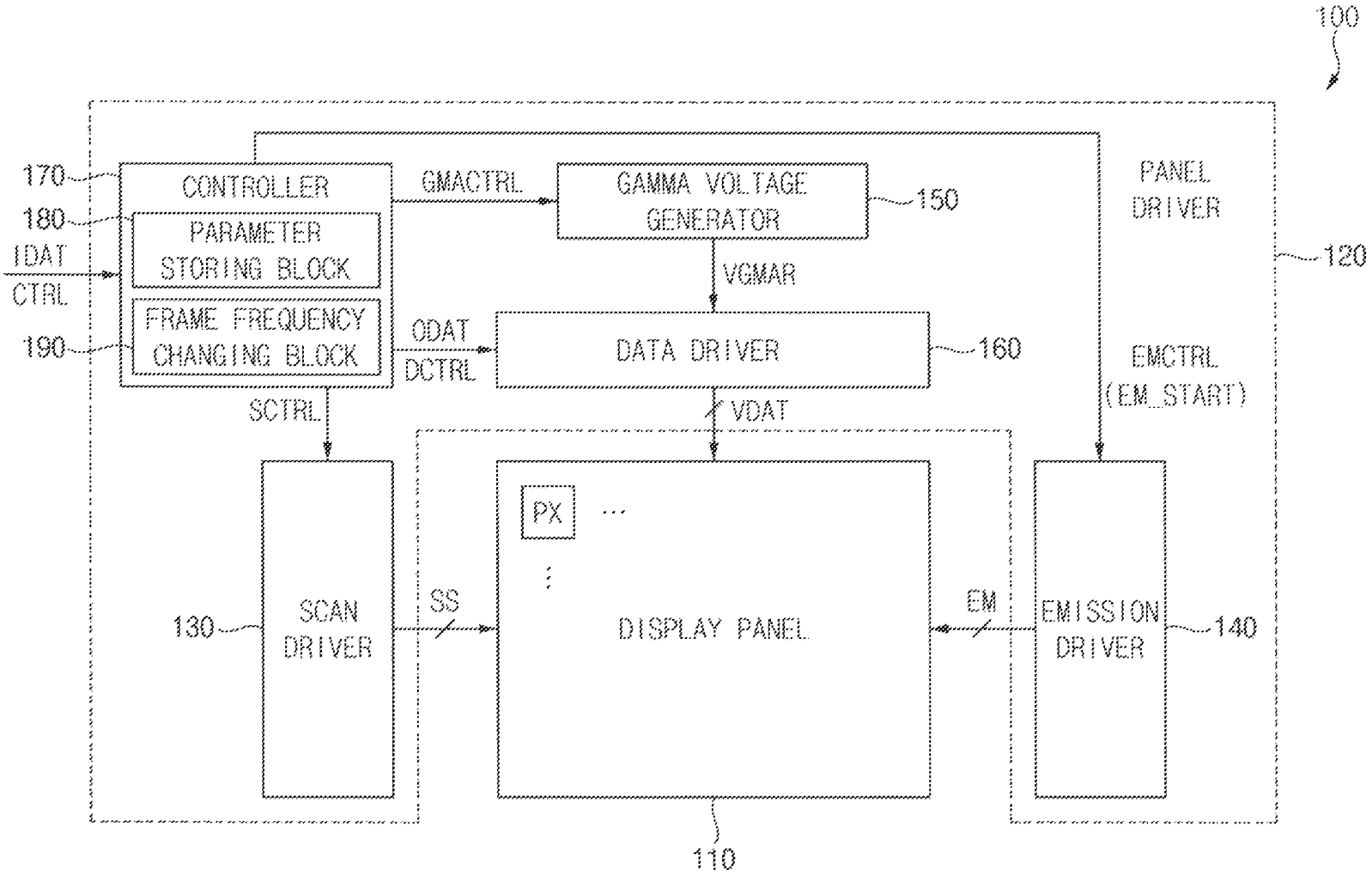
FIG. 1 is a block diagram illustrating an organic light emitting diode (OLED) display device according to embodiments.
Figure 2A:
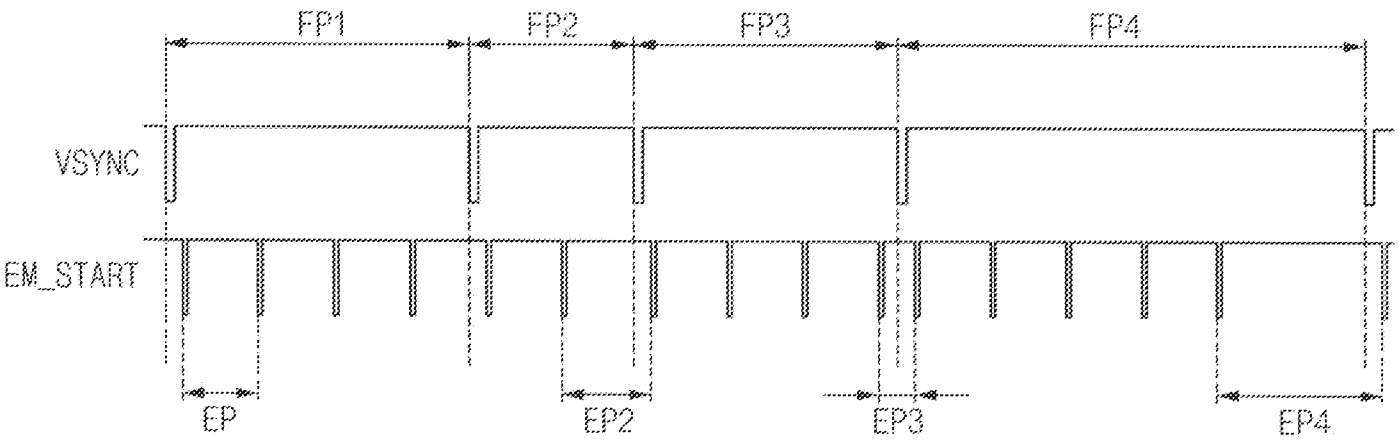
FIG. 2A is a timing diagram illustrating frame periods of a conventional OLED display device.
Figure 2B:
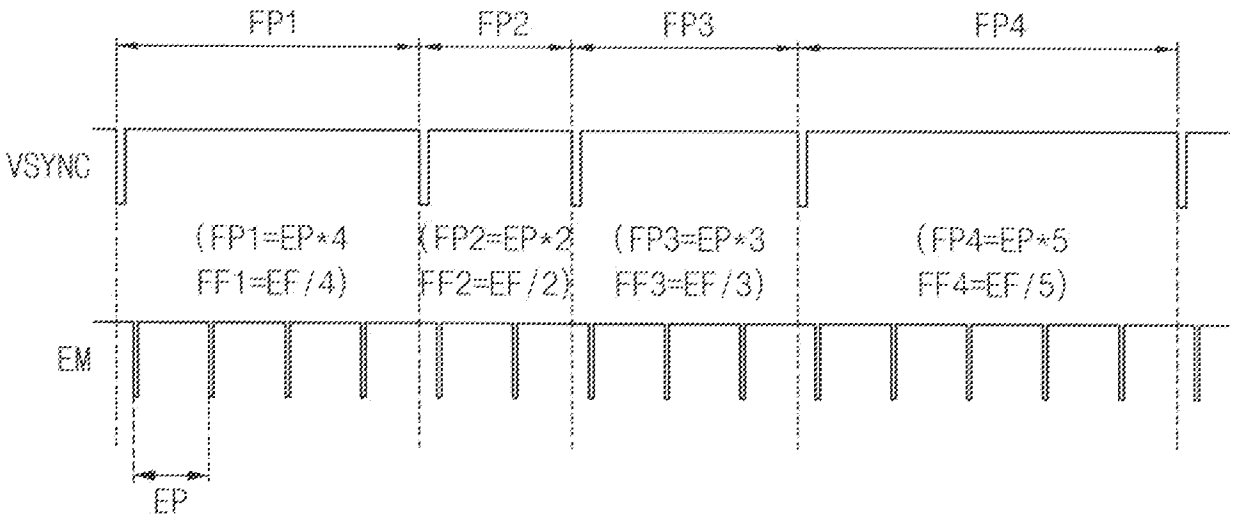
FIG. 2B is a timing diagram illustrating frame periods of an OLED display device according to embodiments.

FIG. 1 is a block diagram illustrating an organic light emitting diode (OLED) display device according to embodiments, FIG. 2A is a timing diagram illustrating frame periods of a conventional OLED display device, FIG. 2B is a timing diagram illustrating frame periods of an OLED display device according to embodiments, and FIG. 3 is a diagram for describing an example of parameter sets stored in an OLED display device according to embodiments.

Referring to FIG. 1, an OLED display device 100 according to embodiments may include a display panel 110 including a plurality of pixels PX, and a panel driver 120 that drives the display panel 110. In some embodiments, the panel driver 120 may include a scan driver 130 that provides scan signals SS to the plurality of pixels PX, an emission driver 140 that provides emission signals EM to the plurality of pixels PX, a gamma voltage generator 150 that generates a gamma reference voltage VGMAR, a data driver 160 that provides data voltages VDAT to the plurality of pixels PX based on the gamma reference voltage VGMAR, and a controller 170 that controls the scan driver 130, the emission driver 140, the gamma voltage generator 150 and the data driver 160.

The display panel 110 may include a plurality of data lines, a plurality of scan lines, a plurality of emission lines, and a plurality of pixels PX coupled thereto. In some embodiments, each pixel PX may include, but not limited to, a switching transistor that transfers the data voltage VDAT in response to the scan signal SS, a storage capacitor that stores the data voltage VDAT transferred by the switching transistor, a driving transistor that generates a driving current based on the data voltage VDAT stored in the storage capacitor, an emission transistor that selectively forms a path of the driving current in response to the emission signal EM, and an organic light emitting diode (OLED) that emits light based on the driving current generated by the driving transistor. Since the path of the driving current is selectively formed by the emission transistor in response to the emission signal EM, each pixel PX may selectively emit light in response to the emission signal EM.

The scan driver 130 may provide the scan signals SS to the plurality of pixels PX through the plurality of scan lines based on a scan control signal SCTRL received from the controller 170. In some embodiments, the scan driver 130 may sequentially provide the scan signals SS to the plurality of pixels PX on a row-by-row basis. In some embodiments, the scan control signal SCTRL may include, but not limited to, a scan start signal and a scan clock signal. In some embodiments, the scan driver 130 may be integrated or formed in a peripheral portion of the display panel 110. In other embodiments, the scan driver 130 may be implemented with one or more integrated circuits (IC s).

The emission driver 140 may provide the emission signals EM to the plurality of pixels PX through the plurality of emission lines based on an emission control signal EMCTRL received from the controller 170. In some embodiments, the emission control signal EMCTRL may include, but not limited to, an emission start signal EM_START and an emission clock signal. In some embodiments, the emission driver 140 may sequentially provide the emission signals EM to the plurality of pixels PX on a row-by-row basis such that the plurality of pixels PX may sequentially emit light on the row-by-row basis. For example, the emission driver 140 may periodically receive the emission start signal EM_START, and may sequentially provide the emission signals EM to the plurality of pixels PX on the row-by-row basis by sequentially shifting the emission start signal EM_START in response to the emission clock signal.

In other embodiments, the emission driver 140 may substantially simultaneously provide the emission signals EM to the plurality of pixels PX such that the plurality of pixels PX may substantially simultaneously emit light. Further, in some embodiments, the emission driver 140 may receive the emission start signal EM_START with a substantially constant emission period, and may provide the emission signal EM to each pixel with the substantially constant emission period. In some embodiments, the emission driver 140 may be integrated or formed in the peripheral portion of the display panel 110. In other embodiments, the emission driver 140 may be implemented with one or more ICs.

The gamma voltage generator 150 may be controlled by a gamma control signal GMACTRL received from the controller 170, and may generate one or more gamma reference voltages VGMAR. In some embodiments, the gamma control signal GMACTRL may represent a (current) gamma set, or voltage levels of the gamma reference voltages VGMAR, and the gamma voltage generator 150 may generate the gamma reference voltages VGMAR corresponding to the gamma set represented by the gamma control signal GMACTRL. In some embodiments, the gamma voltage generator 150 may be included in the data driver 160. In other embodiments, the gamma voltage generator 150 may be located outside the data driver 160.

The data driver 160 may receive output image data ODAT and a data control signal DCTRL from the controller 170, may receive the gamma reference voltages VGMAR from the gamma voltage generator 150, and may provide the data voltages VDAT to the plurality of pixels PX through the plurality of data lines based on the output image data ODAT, the data control signal DCTRL and the gamma reference voltages VGMAR. In some embodiments, the data driver 160 may generate respective gray voltages corresponding to respective gray levels based on the gamma reference voltages VGMAR, may select the gray voltages corresponding to the output image data ODAT, and may provide, as the data voltages VDAT, the selected gray voltages to the plurality of pixels PX. In some embodiments, the data control signal DCTRL may include, but not limited to, an output data enable signal, a horizontal start signal and a load signal. In some embodiments, the data driver 160 and the controller 170 may be implemented with a single integrated circuit, and the single integrated circuit may be referred to as a timing controller embedded data driver (TED). In other embodiments, the data driver 160 and the controller 170 may be implemented with separate integrated circuits.

The controller (e.g., a timing controller) 170 may receive input image data IDAT and a control signal CTRL from an external host processor (e.g., an application processor (AP), a graphic processing unit (GPU) or a graphic card). In some embodiments, the input image data IDAT may be RGB image data including red image data, green image data and blue image data. In some embodiments, the control signal CTRL may include, but not limited to, an external vertical synchronization signal, an external horizontal synchronization signal, an input data enable signal, a master clock signal, etc. The controller 170 may generate the scan control signal SCTRL, the emission control signal EMCTRL, the gamma control signal GMACTRL, the data control signal DCTRL and the output image data ODAT based on the control signal CTRL and the input image data IDAT. The controller 170 may control an operation of the scan driver 130 by providing the scan control signal SCTRL to the scan driver 130, may control an operation of the emission driver 140 by providing the emission control signal EMCTRL to the emission driver 140, may control an operation of the gamma voltage generator 150 by providing the gamma control signal GMACTRL to the gamma voltage generator 150, and may control an operation of the data driver 160 by providing the data control signal DCTRL and the output image data ODAT to the data driver 160.

The OLED display device 100 according to embodiments may receive the input image data IDAT at a variable frame frequency (or a variable frame rate) from the host processor. A mode in which the input image data IDAT are received at the variable frame frequency may be referred to as an adaptive sync mode. For example, the adaptive sync mode may include, but not limited to, a Free-Sync mode, a G-Sync mode, a Q-Sync mode, etc.

However, in a conventional OLED display device employing an impulsive driving method that allows each OLED to emit light and not to emit light periodically, a frame frequency of the input image data IDAT received from the host processor may be changed to any frequency, and a frame frequency for driving the display panel 110 may be changed to any frequency in synchronization with the frame frequency of the input image data IDAT. In the conventional OLED display device, a ratio of an emission period to an entire frame period, or an emission duty ratio may be changed in each frame period, and a flicker may occur. For example, as illustrated in FIG. 2A, the conventional OLED display device may generate an internal vertical synchronization signal VSYNC for defining each frame period FP1, FP2, FP3 and FP4 at any time point in synchronization with the external vertical synchronization signal received from the host processor. In this case, the emission period EP of each pixel PX of the display panel 110 may not be maintained as substantially constant, and the last emission period EP2, EP3 and EP4 in each frame period FP2, FP3 and FP4 may be increased or decreased compared with desired emission period EP. Thus, the emission duty ratio may be changed in the frame period FP2, FP3 and FP4 having the increased or decreased emission period EP2, EP3 and EP4, and the flicker may be caused by the change of the emission duty ratio.

However, in the OLED display device 100 according to embodiments, the panel driver 120 may drive the display panel 110 at a frame frequency corresponding to 1/N of an emission frequency such that each frame period corresponds to an N multiple of an emission period, where N is an integer greater than 1. In this case, the emission duty ratio in each frame period may be maintained as substantially constant, and the flicker may be prevented from occurring. For example, as illustrated in FIG. 2B, the controller 140 of the panel driver 120 of the OLED display device 100 according to embodiments may generate an internal vertical synchronization signal VSYNC such that a time length of the emission period EP is maintained as substantially constant. That is, the controller 140 of the panel driver 120 may generate the internal vertical synchronization signal VSYNC such that each frame period FP1, FP2, FP3 and FP4 corresponds to an N multiple of the emission period EP, and the panel driver 120 may drive the display panel 110 at a frame frequency FF1, FF2, FF3 and FF4 corresponding to 1/N of an emission frequency EF based on the internal vertical synchronization signal VSYNC. For example, a first frame period FP1 may be four times of the emission period EP, a first frame frequency FF1 of the first frame period FP1 may be ¼ of the emission frequency EF, a second frame period FP2 may be two times of the emission period EP, a second frame frequency FF2 of the second frame period FP2 may be ½ of the emission frequency EF, a third frame period FP3 may be three times of the emission period EP, a third frame frequency FF3 of the third frame period FP3 may be ⅓ of the emission frequency EF, a fourth frame period FP4 may be five times of the emission period EP, and a fourth frame frequency FF4 of the fourth frame period FP4 may be ⅕ of the emission frequency EF. In this case, since the emission period EP is maintained as substantially constant, the emission duty ratio in each frame period FP1, FP2, FP3 and FP4 may be maintained as substantially constant, and thus the flicker may be prevented from occurring.

However, although the display panel 110 is driven at the frame frequency corresponding to the 1/N of the emission frequency such that each frame period corresponds to the N multiple of the emission period, if the frame frequency is rapidly changed, a luminance change caused by the rapid change of the frame frequency may be perceived by a user. In some embodiments, when an image displayed by the OLED display device 100 is not changed, or when the OLED display device 100 displays a still image, the host processor may not provide the input image data IDAT to the OLED display device 100, the OLED display device 100 may store input image data IDAT that are previously received, and the OLED display device 100 may display an image based on the stored input image data IDAT. Further, in a case where the image is displayed based on the stored input image data IDAT, the OLED display device 100 may drive the display panel 110 at a low or minimum frame frequency to reduce power consumption. Thus, when the input image data IDAT are not received (for a predetermined time or a planned frame time) after the input image data IDAT are received, the frame frequency for driving the display panel 110 may be rapidly decreased, and a luminance change caused by the rapid decrease of the frame frequency may be perceived by the user. Further, when the input image data IDAT are received after the input image data IDAT are not received, the frame frequency for driving the display panel 110 may be rapidly increased, and a luminance change caused by the rapid increase of the frame frequency may be perceived by the user.

However, in the OLED display device 100 according to embodiments, the panel driver 120 may gradually decrease the frame frequency of the display panel 110 in a case where the input image data IDAT are not received and may gradually increase the frame frequency of the display panel 110 in a case where the input image data IDAT are received. For example, the panel driver 120 may gradually increase the number of the emission periods within each frame period in the case where the input image data IDAT are not received and may gradually decrease the number of the emission periods within each frame period in the case where the input image data IDAT are received. In some embodiments, to gradually increase the number of the emission periods within each frame period, the panel driver 120 may increase a planned frame time of a next frame period by M emission periods than a planned frame time of a current frame period in the case where the input image data IDAT are not received during the planned frame time of the current frame period, where M is an integer greater than 0. Further, to gradually decrease the number of the emission periods within each frame period, the panel driver 120 may decrease the planned frame time of the next frame period by K emission periods than the planned frame time of the current frame period in the case where the input image data IDAT are received during the planned frame time of the current frame period, where K is an integer greater than 0. Accordingly, in the OLED display device 100 according to embodiments, the frame frequency for driving the display panel 110 may be gradually changed, and the luminance change of the display panel 110 caused by the rapid change of the frame frequency may be prevented from being perceived by the user.

In some embodiments, the OLED display device 100 may store a plurality of gamma sets corresponding to respective frame frequencies. When the frame frequency of the display panel 110 is changed, the panel driver 120 may change a gamma set for generating the data voltages VDAT provided to the plurality of pixels PX to one of the plurality of gamma sets corresponding to the changed frame frequency. In this case, the luminance change of the display panel 110 caused by the change of the frame frequency may be further prevented from being perceived by the user.

Further, in some embodiments, to gradually change the frame frequency of the display panel 110, the panel driver 120 may determine a planned frame time of a next frame period based on a planned frame time of a current frame period and whether the input image data IDAT are received in the current frame period, may determine a parameter set in the next frame period based on the planned frame time of the next frame period, and may drive the display panel 110 based on the determined parameter set in the next frame period. To perform these operations, in some embodiments, the controller 170 may include a parameter storing block 180 that stores a plurality of parameter sets, and a frame frequency changing block 190 that changes the frame frequency for driving the display panel 110 based on the plurality of parameter sets.

The parameter storing block 180 may store the plurality of parameter sets respectively corresponding to a plurality of frame time ranges. In some embodiments, as illustrated in a table 210 of FIG. 3, the parameter storing block 180 may store a plurality of range parameters P_RANGE_LIMIT1, P_RANGE_LIMIT2 and P_RANGE_LIMIT3 for defining the plurality of frame time ranges and may store the plurality of parameter sets P_SET1, P_SET2, P_SET3 and P_SET4 respectively corresponding to the plurality of frame time ranges. For example, a first range parameter P_RANGE_LIMIT1 may represents an upper limit of a first frame time range, a second range parameter P_RANGE_LIMIT2 may represents an upper limit of a second frame time range, and a third range parameter P_RANGE_LIMIT3 may represents an upper limit of a third frame time range. Further, a parameter set of a current frame period may be determined as a first parameter set P_SET1 in a case where a planned frame time is less than or equal to the upper limit of the first frame time range, may be determined as a second parameter set P_SET2 in a case where the planned frame time is greater than the upper limit of the first frame time range and less than or equal to the upper limit of the second frame time range, may be determined as a third parameter set P_SET3 in a case where the planned frame time is greater than the upper limit of the second frame time range and less than or equal to the upper limit of the third frame time range, and may be determined as a fourth parameter set P_SET4 in a case where the planned frame time is greater than the upper limit of the third frame time range.

Further, in some embodiments, as illustrated in the table 210 of FIG. 3, each parameter set P_SET1, P_SET2, P_SET3 and P_SET4 stored in the parameter storing block 180 may include a gamma set GAMMA_SET1, GAMMA_SET2, GAMMA_SET3 and GAMMA_SET4, a decreasing step parameter P_STEP_D1, P_STEP_D2, P_STEP_D3 and P_STEP_D4, an increasing step parameter P_STEP_I1, P_STEP_I2, P_STEP_I3 and P_STEP_I4, a decreasing hold frame parameter P_HOLD_FR_D1, P_HOLD_FR_D2, P_HOLD_FR_D3 and P_HOLD_FR_D4, and an increasing hold frame parameter P_HOLD_FR_I1, P_HOLD_FR_I2, P_HOLD_FR_I3 and P_HOLD_FR_I4. Each gamma set GAMMA_SET1, GAMMA_SET2, GAMMA_SET3 and GAMMA_SET4 may represent the gamma reference voltages VGMAR for generating the data voltages VDAT provided to the plurality of pixels PX. The panel driver 120 may generate the data voltages VDAT based on the gamma reference voltages VGMAR corresponding to a gamma set (e.g., GAMMA_SET1) of a current parameter set (e.g., P_SET1), and thus may provide the data voltages VDAT corresponding to a current frame frequency to the plurality of pixels PX. Further, each decreasing step parameter P_STEP_D1, P_STEP_D2, P_STEP_D3 and P_STEP_D4 may represent the number of the emission periods within a frame period which is to be increased when the frame frequency is decreased. In a case where the input image data IDAT are not received, the panel driver 120 may increase (the planned frame time of) the next frame period by the number of the emission periods represented by a decreasing step parameter (e.g., P_STEP_D1) of a current parameter set (e.g., P_SET1), and thus may decrease the frame frequency of the next frame period. Further, each increasing step parameter P_STEP_I1, P_STEP_I2, P_STEP_I3 and P_STEP_I4 may represent the number of the emission periods within a frame period which is to be decreased when the frame frequency is increased. In a case where the input image data IDAT are received, the panel driver 120 may decrease (the planned frame time of) the next frame period by the number of the emission periods represented by an increasing step parameter (e.g., P_STEP_I1) of a current parameter set (e.g., P_SET1), and thus may increase the frame frequency of the next frame period. Each decreasing hold frame parameter P_HOLD_FR_D1, P_HOLD_FR_D2, P_HOLD_FR_D3 and P_HOLD_FR_D4 may represent the number of the frame periods having a decreased frame frequency when the frame frequency is decreased. In the case where the input image data IDAT are not received, the panel driver 120 may increase (the planned frame time of) the next frame period by the number of the emission periods represented by the decreasing step parameter (e.g., P_STEP_D1) of the current parameter set (e.g., P_SET1), and may repeat the increased next frame period by the number of times represented by a decreasing hold frame parameter (e.g., P_HOLD_FR_D1) of the current parameter set (e.g., P_SET1). Each increasing hold frame parameter P_HOLD_FR_I1, P_HOLD_FR_I2, P_HOLD_FR_I3 and P_HOLD_FR_I4 may represent the number of the frame periods having an increased frame frequency when the frame frequency is increased. In the case where the input image data IDAT are received, the panel driver 120 may decrease (the planned frame time of) the next frame period by the number of the emission periods represented by the increasing step parameter (e.g., P_STEP_I1) of the current parameter set (e.g., P_SET1), and may repeat the decreased next frame period by the number of times represented by an increasing hold frame parameter (e.g., P_HOLD_FR_I1) of the current parameter set (e.g., P_SET1).

Further, in some embodiments, as illustrated in a table 230 of FIG. 3, the parameter storing block 180 may further store a gaming mode parameter P_GAME_OP representing whether an operation mode of the OLED display device 100 is a gaming mode, a threshold frame parameter P_FR_TH corresponding to a frame time threshold value, an active cycle parameter P_ACT_CYC representing the number of the emission periods within an active period of the frame period, a minimum frame parameter P_FR_MIN corresponding to a maximum frame time, and a maximum frame parameter P_FR_MAX corresponding to a maximum frame time.

The frame frequency changing block 190 may change the frame frequency of the display panel 110 by using the plurality of parameter sets P_SET1, P_SET2, P_SET3 and P_SET4 stored in the parameter storing block 180.

For example, in the case where the input image data IDAT are not received in the current frame period, the frame frequency changing block 190 may finish the current frame period when a time of the current frame period becomes the planned frame time of the current frame period. Further, the frame frequency changing block 190 may calculate the planned frame time of the next frame period by adding a product of the emission period and the decreasing step parameter (e.g., P_STEP_D1) of the current parameter set (e.g., P_SET1) in the current frame period to the planned frame time of the current frame period. Thus, the planned frame time of the next frame period may be increased by an integer multiple of the emission period than the planned frame time of the current frame period, and the frame frequency of the next frame period may be decreased from the frame frequency of the current frame period. In some embodiments, in a case where the product of the emission period and the decreasing step parameter in the current frame period added to the planned frame time of the current frame period is greater than the maximum frame time represented by the maximum frame parameter P_FR_MAX, the frame frequency changing block 190 may determine the planned frame time of the next frame period as the maximum frame time. Further, the frame frequency changing block 190 may determine the parameter set of the next frame period as one of the plurality of parameter sets P_SET1, P_SET2, P_SET3 and P_SET4 corresponding to the planned frame time of the next frame period.

In another example, in the case where the input image data IDAT are received in the current frame period, the frame frequency changing block 190 may calculate a finished frame time of the current frame period by subtracting a product of the emission period and the increasing step parameter (e.g., P_STEP_I1) of the current parameter set (e.g., P_SET1) in the current frame period from the planned frame time of the current frame period, and may finish the current frame period when a time of the current frame period becomes the finished frame time of the current frame period. Further, the frame frequency changing block 190 may determine the planned frame time of the next frame period as the finished frame time of the current frame period. Thus, the planned frame time of the next frame period may be decreased by an integer multiple of the emission period than the planned frame time of the current frame period, and the frame frequency of the next frame period may be increased from the frame frequency of the current frame period. In some embodiments, in a case where the product of the emission period and the increasing step parameter in the current frame period subtracted from the planned frame time of the current frame period is less than the minimum frame time represented by the minimum frame parameter P_FR_MIN, the frame frequency changing block 190 may determine the planned frame time of the next frame period as the minimum frame time. Further, in some embodiments, in a case where the product of the emission period and the increasing step parameter in the current frame period subtracted from the planned frame time of the current frame period is greater than the frame time threshold value represented by the threshold frame parameter P_FR_TH, the frame frequency changing block 190 may determine the planned frame time of the next frame period as the minimum frame time. Further, the frame frequency changing block 190 may determine the parameter set of the next frame period as one of the plurality of parameter sets P_SET1, P_SET2, P_SET3 and P_SET4 corresponding to the planned frame time of the next frame period.

Further, in some embodiments, in a case where the gaming mode parameter P_GAME_OP indicates the gaming mode, the frame frequency changing block 190 may determine a planned frame time of each frame period as the maximum frame time represented by the maximum frame parameter P_FR_MAX. Further, the frame frequency changing block 190 may finish a current frame period when the input image data IDAT are received. Thus, in the gaming mode, while each frame period of the display panel 110 is maintained as an integer multiple of the emission period, the frame frequency of the display panel 110 may be determined by the frame frequency of the input image data IDAT. Further, the frame frequency changing block 190 may determine the parameter set of the next frame period based on a finished frame time of the current frame period.

As described above, in the OLED display device 100 according to embodiments, the panel driver 120 may drive the display panel 110 at the frame frequency corresponding to 1/N of the emission frequency such that each frame period corresponds to the N multiple of the emission period. Accordingly, even if the input image data IDAT are received at the variable frame rate (or the variable frame frequency), the emission duty ratio in each frame period may be maintained as substantially constant, and the flicker may be prevented from occurring. Further, in the OLED display device 100 according to embodiments, the panel driver 120 may gradually decrease the frame frequency of the display panel 110 in the case where the input image data IDAT are not received and may gradually increase the frame frequency of the display panel 110 in the case where the input image data IDAT are received. Accordingly, even if the frame rate (or the frame frequency) of the input image data IDAT is rapidly changed, the luminance change caused by the change of the frame frequency may not be perceived by the user.

Figure 4:
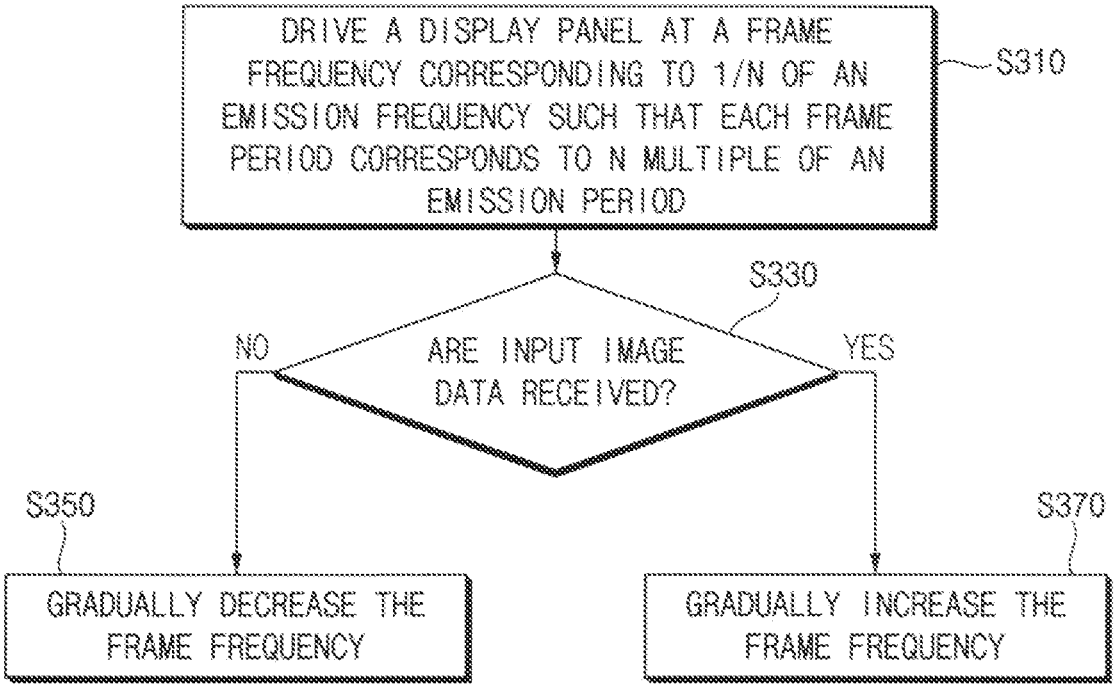
FIG. 4 is a flowchart illustrating a method of operating an OLED display device according to embodiments.

FIG. 4 is a flowchart illustrating a method of operating an OLED display device according to embodiments.

Referring to FIGS. 1 and 4, in a method of operating an OLED display device 100 according to embodiments, a panel driver 120 may drive a display panel 110 at a frame frequency corresponding to 1/N of an emission frequency such that each frame period corresponds to an N multiple of an emission period (S310), where N is an integer greater than 1. Accordingly, an emission duty ratio in each frame period may be maintained as substantially constant, and a flicker may be prevented from occurring.

In a case where input image data IDAT are not received (S330: NO), the panel driver 120 may gradually decrease the frame frequency of the display panel 110 (S350). To gradually decrease the frame frequency of the display panel 110, the panel driver 120 may gradually increase the number of the emission periods within (a blank period of) the frame period. In some embodiments, to gradually decrease the frame frequency of the display panel 110, the panel driver 120 may increase a planned frame time of a next frame period by M emission periods than a planned frame time of a current frame period in the case where the input image data IDAT are not received during the planned frame time of the current frame period, where M is an integer greater than 0. Further, if the planned frame time of the next frame period is increased, or if the frame frequency of the display panel 110 is decreased, the panel driver 120 may change a gamma set for generating data voltages VDAT provided to a plurality of pixels PX.

Further, in a case where input image data IDAT are received (S330: YES), the panel driver 120 may gradually increase the frame frequency of the display panel 110 (S370). To gradually increase the frame frequency of the display panel 110, the panel driver 120 may gradually decrease the number of the emission periods within (the blank period of) the frame period. In some embodiments, to gradually increase the frame frequency of the display panel 110, the panel driver 120 may decrease the planned frame time of the next frame period by K emission periods than the planned frame time of the current frame period in the case where the input image data IDAT are received during the planned frame time of the current frame period, where K is an integer greater than 0. Further, if the planned frame time of the next frame period is decreased, or if the frame frequency of the display panel 110 is increased, the panel driver 120 may change the gamma set for generating the data voltages VDAT provided to the plurality of pixels PX.

As described above, in the method of operating the OLED display device 100 according to embodiments, the panel driver 120 may drive the display panel 110 at the frame frequency corresponding to 1/N of the emission frequency such that each frame period corresponds to the N multiple of the emission period. Accordingly, even if the input image data IDAT are received at a variable frame rate (or a variable frame frequency), the emission duty ratio in each frame period may be maintained as substantially constant, and the flicker may be prevented from occurring. Further, in the method of operating the OLED display device 100 according to embodiments, the panel driver 120 may gradually decrease the frame frequency of the display panel 110 in the case where the input image data IDAT are not received and may gradually increase the frame frequency of the display panel 110 in the case where the input image data IDAT are received. Accordingly, even if the frame rate (or the frame frequency) of the input image data IDAT is rapidly changed, a luminance change caused by the change of the frame frequency may not be perceived by the user.

Figure 5:
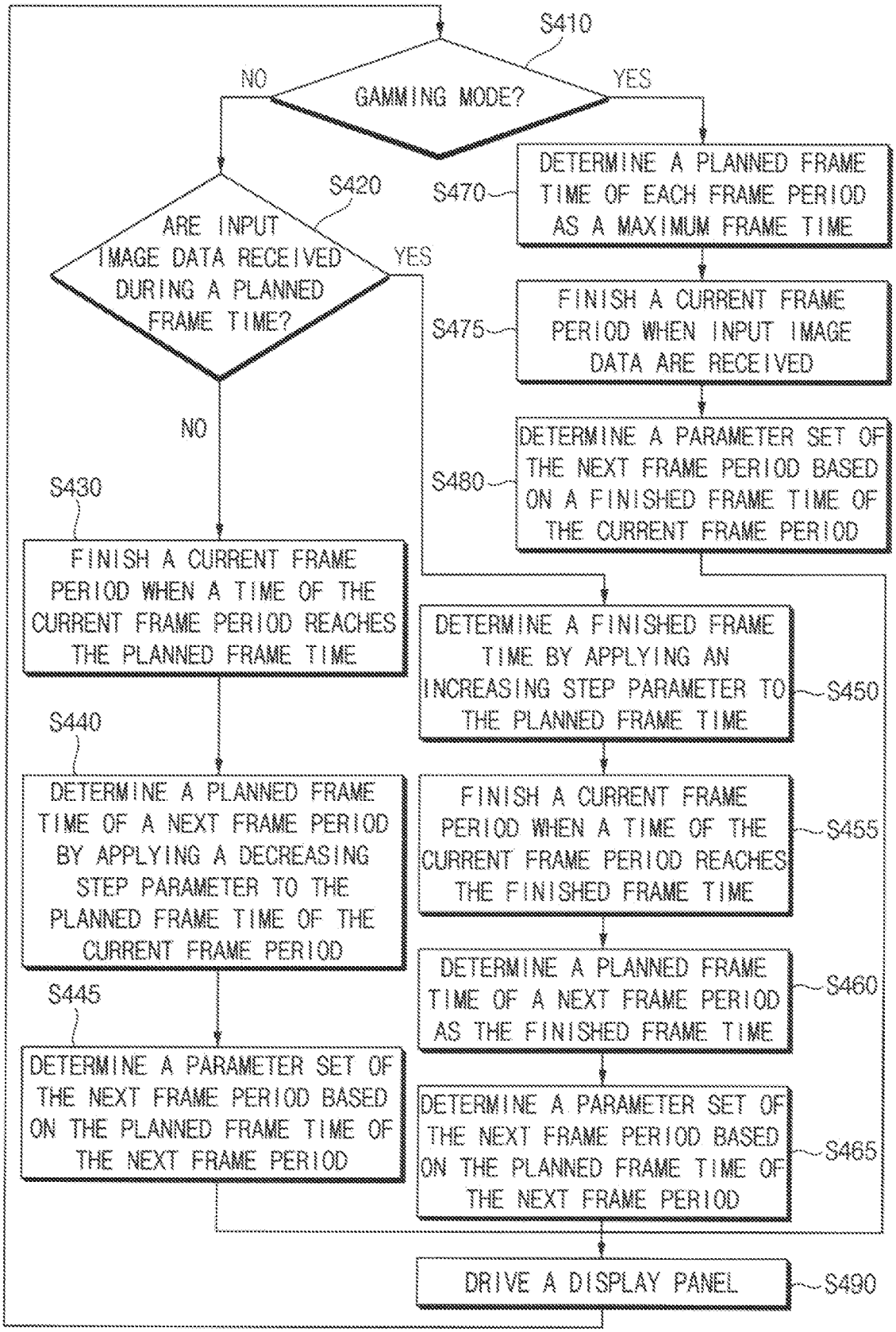
FIG. 5 is a flowchart illustrating a method of operating an OLED display device according to embodiments.
Figure 7:
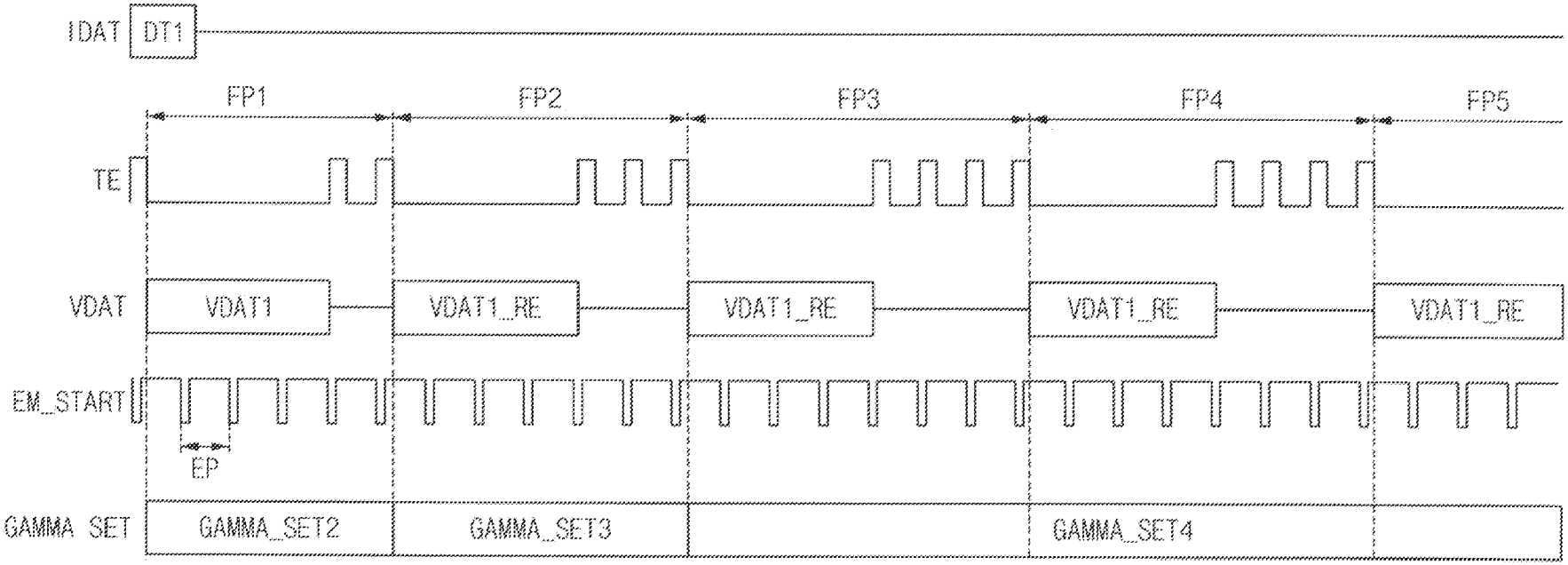
FIG. 7 is a timing diagram illustrating an example of frame periods that are changed by using parameter sets of FIG. 6 in a case where input image data are not received.
Figure 9:
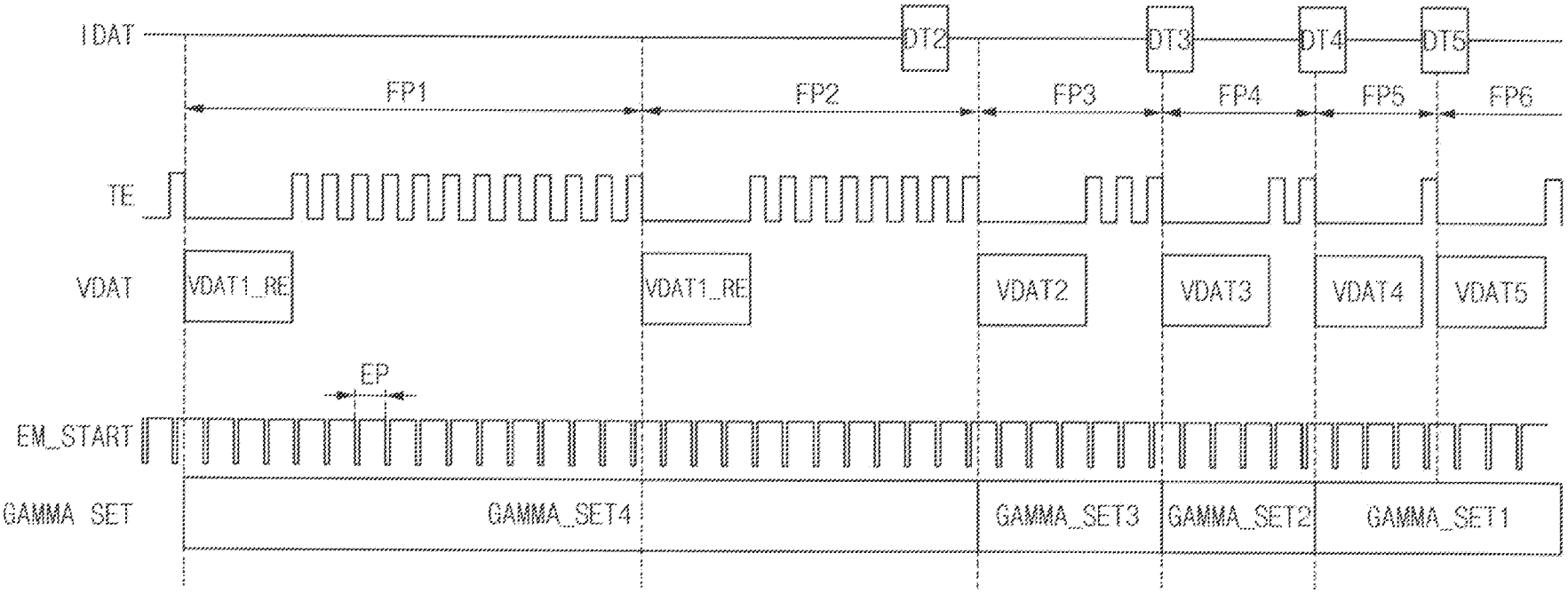
FIG. 9 is a timing diagram illustrating an example of frame periods that are changed by using parameter sets of FIG. 8 in a case where input image data are received.
Figure 11:
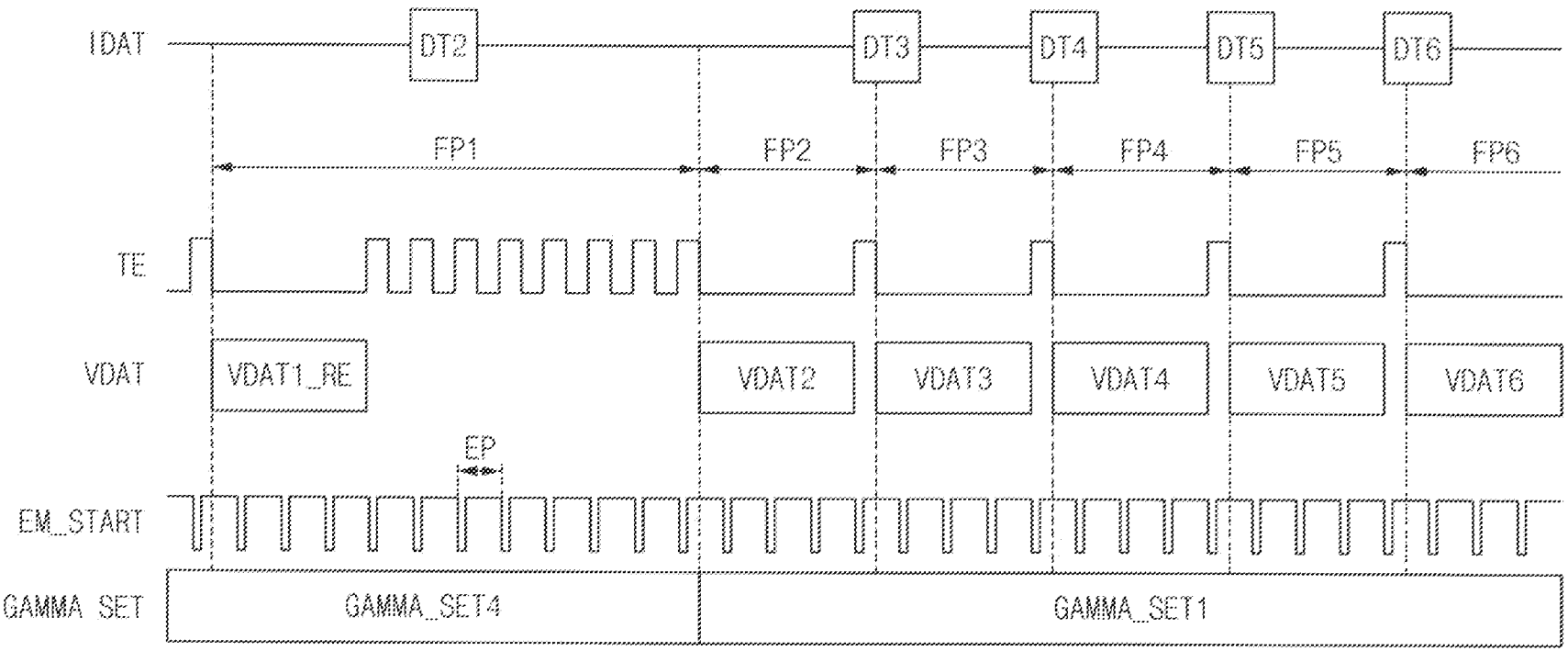
FIG. 11 is a timing diagram illustrating an example of frame periods that are changed by using parameter sets of FIG. 10 in a case where input image data are received.
Figure 13:
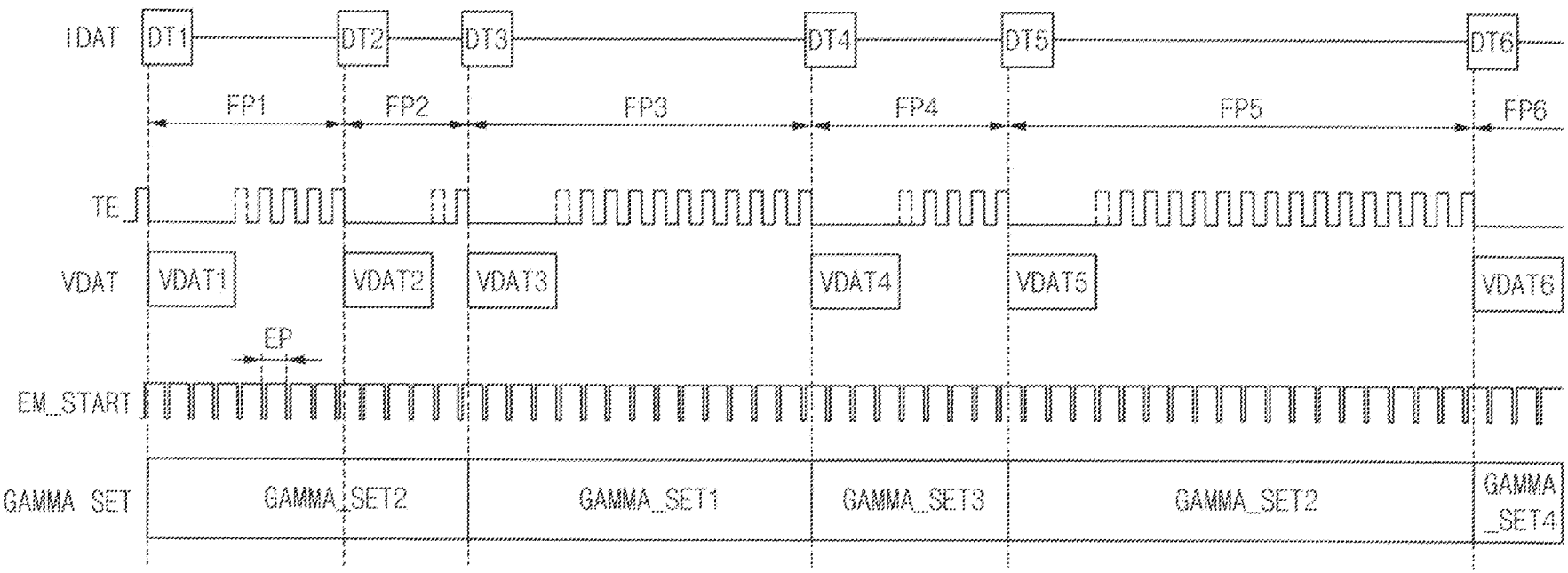
FIG. 13 is a timing diagram illustrating an example of frame periods that are changed by using parameter sets of FIG. 12 in a gaming mode.

FIG. 5 is a flowchart illustrating a method of operating an OLED display device according to embodiments. FIG. 6 is a diagram illustrating an example of parameter sets and FIG. 7 is a timing diagram illustrating an example of frame periods that are changed by using parameter sets of FIG. 6 in a case where input image data are not received. FIG. 8 is a diagram illustrating another example of parameter sets and FIG. 9 is a timing diagram illustrating an example of frame periods that are changed by using parameter sets of FIG. 8 in a case where input image data are received. FIG. 10 is a diagram illustrating still another example of parameter sets and FIG. 11 is a timing diagram illustrating an example of frame periods that are changed by using parameter sets of FIG. 10 in a case where input image data are received. FIG. 12 is a diagram illustrating still another example of parameter sets and FIG. 13 is a timing diagram illustrating an example of frame periods that are changed by using parameter sets of FIG. 12 in a gaming mode.

Referring to FIGS. 1 and 5, if an operation mode of an OLED display device 100 is not a gaming mode (S410: NO), and input image data IDAT are not received (S420: NO), a panel driver 120 may gradually decrease a frame frequency of a display panel 110 (S430, S440, S445 and S490). In some embodiments, in a case where the input image data IDAT are not received for a planned frame time of a current frame period (S420: NO), the panel driver 120 may finish the current frame period when a time of the current frame period reaches or becomes the planned frame time of the current frame period (S430), may determine or calculate a planned frame time of a next frame period by applying a decreasing step parameter in the current frame period to the planned frame time of the current frame period, or by adding a product of the emission period and the decreasing step parameter to the planned frame time of the current frame period (S440), may determine a parameter set of the next frame period based on the planned frame time of the next frame period (S445), and may drive the display panel 110 based on the calculate planned frame time and the determined parameter set in the next frame period (S490).

For example, in the case where the input image data IDAT are not received, the panel driver 120 storing parameter sets P_SET1, P_SET2, P_SET3 and P_SET4 of FIG. 6 may drive the display panel 110 as illustrated in FIG. 7. In FIG. 7, TE may represent a tearing effect signal, and the tearing effect signal TE may have at least one pulse having an interval corresponding to an emission period EP in a blank period of each frame period FP1, FP2, FP3, FP4 and FP5 to prevent a tearing phenomenon from occurring. In each frame period FP1, FP2, FP3, FP4 and FP5, the number of pulses of the tearing effect signal TE may be greater by one than the number of the emission periods EP in the blank period. In some embodiments, the tearing effect signal TE may be generated by the panel driver 120, and may be provided to a host processor.

As illustrated in FIGS. 6 and 7, if the panel driver 120 receives first frame data DT1 as the input image data IDAT, the panel driver 120 may provide first data voltages VDAT1 corresponding to the first frame data DT1 to the plurality of pixels PX in a first frame period FP1. FIG. 7 illustrates an example where a planned frame time of the first frame period FP1 corresponds to five emission periods EP. Further, an active period of each frame period FP1, FP2, FP3, FP4 and FP5 may have a time length corresponding to four emission periods EP by an active cycle parameter P_ACT_CYC of 4, and the planned frame time of the first frame period FP1 may correspond to a sum of a time length of the four emission periods EP in the active period and a time length of one emission period EP in the blank period. As illustrated in FIG. 6, each range parameter P_RANGE_LIMIT1, P_RANGE_LIMIT2 and P_RANGE_LIMIT3 may represent the number of the emission periods EP in the blank period corresponding to an upper limit of a corresponding frame time range to defining each frame time range. Thus, the panel driver 120 storing the parameter sets P_SET1, P_SET2, P_SET3 and P_SET4 of FIG. 6 may select a first parameter set P_SET1 in a case where the planned frame time corresponds to a time length of a frame period having no emission period EP in the blank period, or in a case where the planned frame time corresponds to a time length of the four emission periods EP in the active period, may select a second parameter set P_SET2 in a case where the planned frame time corresponds to a time length of a frame period having one emission period EP in the blank period, or in a case where the planned frame time corresponds to a sum of a time length of the four emission periods EP in the active period and a time length of the one emission period EP in the blank period, may select a third parameter set P_SET3 in a case where the planned frame time corresponds to a time length of a frame period having two emission periods EP in the blank period, or in a case where the planned frame time corresponds to a sum of the time length of the four emission periods EP in the active period and a time length of the two emission periods EP in the blank period, and may select a fourth parameter set P_SET4 in a case where the planned frame time is longer than or equal to a time length of seven emission periods EP. In the example of FIG. 7, since the planned frame time of the first frame period FP1 corresponds to the time length of the frame period having the one emission period EP in the blank period, a parameter set of the first frame period FP1 may be determined as the second parameter set P_SET2. Thus, the panel driver 120 may drive the display panel 110 based on a second gamma set GAMMA_SET2 of the second parameter set P_SET2 in the first frame period FP1.

In a case where the input image data IDAT are not received during the planned frame time of the first frame period FP1, the panel driver 120 may finish the first frame period FP1 when a time of the first frame period FP1 becomes the planned frame time of the first frame period FP1. Further, the panel driver 120 may calculate a planned frame time of a second frame period FP2 by adding a product of the emission period EP and a decreasing step parameter P_STEP_D2 of the second parameter set P_SET2 to the planned frame time of the first frame period FP1. That is, since the decreasing step parameter P_STEP_D2 of the second parameter set P_SET2 has a value of 1, the planned frame time of the second frame period FP2 may correspond to the time length of the frame period having the two emission periods EP in the blank period. Further, since a decreasing hold frame parameter P_HOLD_FR_D2 of the second parameter set P_SET2 has a value of 1, the number of the frame periods FP2 having the planned frame time corresponding to the time length of the frame period having the two emission periods EP in the blank period may be one. Further, since the planned frame time of the second frame period FP2 corresponds to the time length of the frame period having the two emission periods EP in the blank period, a parameter set of the second frame period FP2 may be determined as the third parameter set P_SET3. Thus, the panel driver 120 may drive the display panel 110 based on a third gamma set GAMMA_SET3 of the third parameter set P_SET3 in the second frame period FP2. Further, since the input image data IDAT are not received, the panel driver 120 may provide the first data voltages VDAT1_RE corresponding to the stored first frame data DT1 to the plurality of pixels PX.

In a case where the input image data IDAT are not received during the planned frame time of the second frame period FP2, the panel driver 120 may finish the second frame period FP2 when a time of the second frame period FP2 becomes the planned frame time of the second frame period FP2. Further, the panel driver 120 may calculate a planned frame time of a third frame period FP3 by adding a product of the emission period EP and a decreasing step parameter P_STEP_D3 of the third parameter set P_SET3 to the planned frame time of the second frame period FP2. That is, since the decreasing step parameter P_STEP_D3 of the third parameter set P_SET3 has a value of 1, the planned frame time of the third frame period FP3 may correspond to the time length of the frame period having the three emission periods EP in the blank period. Further, since a decreasing hold frame parameter P_HOLD_FR_D3 of the third parameter set P_SET3 has a value of 1, the number of the frame periods FP3 having the planned frame time corresponding to the time length of the frame period having the three emission periods EP in the blank period may be one. Further, since the planned frame time of the third frame period FP3 corresponds to the time length of the frame period having the three emission periods EP in the blank period, a parameter set of the third frame period FP3 may be determined as the fourth parameter set P_SET4. Thus, the panel driver 120 may drive the display panel 110 based on a fourth gamma set GAMMA_SET4 of the fourth parameter set P_SET4 in the third frame period FP3.

A maximum frame parameter P_FR_MAX may define a maximum frame time and may represent the number of the emission periods EP in a blank period of a frame period having the maximum frame time. In the example of FIG. 6, since the maximum frame parameter P_FR_MAX has a value of 3, the maximum frame time may correspond to a sum of the time length of the four emission periods EP in the active period and the time length of the three emission periods EP in the blank period. Further, since the planned frame time of the third frame period FP3 is the maximum frame time represented by the maximum frame parameter P_FR_MAX, although the input image data IDAT are not received during the planned frame time of the third frame period FP3, a planned frame time of each of subsequent fourth and fifth frame periods FP4 and FP5 may not be increased compared with the planned frame time of the third frame period FP3 and may be determined as the maximum frame time. Further, a parameter set of each of the subsequent fourth and fifth frame periods FP4 and FP5 may be determined as the fourth parameter set P_SET4.

In this manner, in the case where the input image data IDAT are not received, the time length of each frame period FP1, FP2 and FP3 may be gradually increased from the first frame period FP1 corresponding to five emission periods EP to the third frame period FP3 corresponding to seven emission periods EP, and thus the frame frequency in each frame period FP1, FP2 and FP3 may be gradually decreased.

Referring again to FIGS. 1 and 5, if the operation mode of the OLED display device 100 is not the gaming mode (S410: NO), and the input image data IDAT are received (S420: YES), the panel driver 120 may gradually increase the frame frequency of the display panel 110 (S450, S455, S460, S465 and S490). In some embodiments, in a case where the input image data IDAT are received within the planned frame time of the current frame period (S420: YES), the panel driver 120 may determine or calculate a finished frame time of the current frame period by applying an increasing step parameter in the current frame period to the planned frame time of the current frame period, or by subtracting a product of the emission period and the increasing step parameter from the planned frame time of the current frame period (S450), may finish the current frame period when a time of the current frame period reaches or becomes the finished frame time of the current frame period (S455), may determine the planned frame time of the next frame period as the finished frame time of the current frame period (S460), may determine the parameter set of the next frame period based on the planned frame time of the next frame period (S465), and may drive the display panel 110 based on the calculate planned frame time and the determined parameter set in the next frame period (S490).

For example, in the case where the input image data IDAT are received, the panel driver 120 storing parameter sets P_SET1, P_SET2, P_SET3 and P_SET4 of FIG. 8 may drive the display panel 110 as illustrated in FIG. 9. FIGS. 8 and 9 illustrate an example where a planned frame time of a first frame period FP1 corresponds to a maximum frame time represented by the maximum frame parameter P_FR_MAX having a value of 11, or an example where the planned frame time of the first frame period FP1 corresponds to a time length of a frame period including eleven emission periods EP in a blank period. Further, since the planned frame time of the first frame period FP1 corresponds to the time length of the frame period including the eleven emission periods EP in the blank period greater than a third range parameter P_RANGE_LIMIT3 having a value of 7, a parameter set of the first frame period FP1 may be determined as the fourth parameter set P_SET4. Thus, the panel driver 120 may drive the display panel 110 based on the fourth gamma set GAMMA_SET4 of the fourth parameter set P_SET4 in the first frame period FP1.

In a case where the input image data IDAT are not received during the planned frame time of the first frame period FP1, the panel driver 120 may finish the first frame period FP1 when a time of the first frame period FP1 becomes the planned frame time of the first frame period FP1. Since the planned frame time of the first frame period FP1 is the maximum frame time represented by the maximum frame parameter P_FR_MAX, a planned frame time of a subsequent second frame period FP2 also may be determined as the maximum frame time. Further, a parameter set of the second frame period FP2 may be determined as the fourth parameter set P_SET4.

In a case where second frame data DT2 are received as the input image data IDAT within the planned frame time of the second frame period FP2, the panel driver 120 may calculate a finished frame time of the second frame period FP2 by subtracting a product of the emission period EP and an increasing step parameter P_STEP_I4 in the second frame period FP2 from the planned frame time of the second frame period FP2, and may finish the second frame period FP2 when a time of the second frame period FP2 becomes the finished frame time of the second frame period FP2. That is, since the planned frame time of the second frame period FP2 corresponds to the timing length of the frame period including the eleven emission periods EP in the blank period, and the increasing step parameter P_STEP_I4 in the second frame period FP2 has a value of 4, the finished frame time of the second frame period FP2 may correspond to a timing length of a frame period including seven emission periods EP in the blank period. Thus, the second frame period FP2 may be finished when the emission period EP is repeated seven times in the blank period. A planned frame time of a third frame period FP3 may be determined as the finished frame time of the second frame period FP2. That is, the planned frame time of the third frame period FP3 may correspond to the timing length of the frame period including the seven emission periods EP in the blank period.

In some embodiments, in a case where the finished frame time of the current frame period is greater than a frame time threshold value represented by a threshold frame parameter P_FR_TH, the planned frame time of the next frame period may be determined as a minimum frame time represented by a minimum frame parameter P_FR_MIN. In the example of FIG. 9, since the finished frame time of the second frame period FP2 correspond to the timing length of the frame period including the seven emission periods EP in the blank period less than the threshold frame parameter P_FR_TH having a value of 8, the planned frame time of the third frame period FP3 may not be determined as the minimum frame time represented by the minimum frame parameter P_FR_MIN, and may be determined as the finished frame time of the second frame period FP2.

Since the number of the emission periods EP in the blank period corresponding to the planned frame time of the third frame period FP3 is seven greater than a second range parameter P_RANGE_LIMIT2 and less than or equal to the third range parameter P_RANGE_LIMIT3, a parameter set of the third frame period FP3 may be determined as the third parameter set P_SET3. Thus, the panel driver 120 may drive the display panel 110 based on the third gamma set GAMMA_SET3 of the third parameter set P_SET3 in the third frame period FP3. Further, the panel driver 120 may provide second data voltages VDAT2 corresponding to the second frame data DT2 to the plurality of pixels PX in the third frame period FP3.

In a case where third frame data DT3 are received as the input image data IDAT within the planned frame time of the third frame period FP3, the panel driver 120 may calculate a finished frame time of the third frame period FP3 by subtracting a product of the emission period EP and an increasing step parameter P_STEP_I3 in the third frame period FP3 from the planned frame time of the third frame period FP3, and may finish the third frame period FP3 when a time of the third frame period FP3 becomes the finished frame time of the third frame period FP3. That is, since the number of the emission period EP in the blank period corresponding to the planned frame time of the third frame period FP3 is seven, and the increasing step parameter P_STEP_I3 in the third frame period FP3 has a value of 5, the finished frame time of the third frame period FP3 may correspond to a timing length of a frame period including two emission periods EP in the blank period. Thus, the third frame period FP3 may be finished when the emission period EP is repeated two times in the blank period. A planned frame time of a fourth frame period FP4 may be determined as the finished frame time of the third frame period FP3. That is, the planned frame time of the fourth frame period FP4 may correspond to the timing length of the frame period including the two emission periods EP in the blank period. Further, since the number of the emission period EP in the blank period corresponding to the planned frame time of the fourth frame period FP4 is two greater than a first range parameter P_RANGE_LIMIT1 and less than or equal to the second range parameter P_RANGE_LIMIT2, a parameter set of the fourth frame period FP4 may be determined as the second parameter set P_SET2. Thus, the panel driver 120 may drive the display panel 110 based on the second gamma set GAMMA_SET2 of the second parameter set P_SET2 in the fourth frame period FP4. Further, the panel driver 120 may provide third data voltages VDAT3 corresponding to the third frame data DT3 to the plurality of pixels PX in the fourth frame period FP4.

In a case where fourth frame data DT4 are received as the input image data IDAT within the planned frame time of the fourth frame period FP4, the panel driver 120 may calculate a finished frame time of the fourth frame period FP4 by subtracting a product of the emission period EP and an increasing step parameter P_STEP_I2 in the fourth frame period FP4 from the planned frame time of the fourth frame period FP4. Since the number of the emission period EP in the blank period corresponding to the planned frame time of the fourth frame period FP4 is two, and the increasing step parameter P_STEP_I2 in the fourth frame period FP4 has a value of 3, the number of the emission periods EP in the blank period corresponding to the calculated finished frame time of the fourth frame period FP4 may be less than the minimum frame parameter P_FR_MIN. In this case, the finished frame time of the fourth frame period FP4 may be determined as the minimum frame time represented by the minimum frame parameter P_FR_MIN and may correspond to a time length of a frame time having no emission period EP in the blank period. However, since the fourth frame data DT4 are received after the finished frame time of the fourth frame period FP4, the fourth frame period FP4 may be finished in synchronization with timing when the fourth frame data DT4 are received. That is, the fourth frame period FP4 may be finished when a time of the blank period becomes one emission period EP. A planned frame time of a fifth frame period FP5 may correspond to an actual finished frame time of the fourth frame period FP4, or a time length of a frame period having one emission period EP in the blank period. Further, since the number of the emission periods EP in the blank period corresponding to the planned frame time of the fifth frame period FP5 is one less than or equal to the first range parameter P_RANGE_LIMIT1, a parameter set of the fifth frame period FP5 may be determined as the first parameter set P_SET1. Thus, the panel driver 120 may drive the display panel 110 based on the first gamma set GAMMA_SET1 of the first parameter set P_SET1 in the fifth frame period FP5. Further, the panel driver 120 may provide fourth data voltages VDAT4 corresponding to the fourth frame data DT4 to the plurality of pixels PX in the fifth frame period FP5.

In a case where fifth frame data DT5 are received as the input image data IDAT within the planned frame time of the fifth frame period FP5, the panel driver 120 may finish the fifth frame period FP5 when a time of the fifth frame period FP5 becomes the minimum frame time represented by the minimum frame parameter P_FR_MIN. A planned frame time of a sixth frame period FP6 may be the minimum frame time represented by the minimum frame parameter P_FR_MIN, and a parameter set of the sixth frame period FP6 may be determined as the first parameter set P_SET1. Further, the panel driver 120 may provide fifth data voltages VDAT5 corresponding to the fifth frame data DT5 to the plurality of pixels PX in the sixth frame period FP6.

In this manner, in the case where the input image data IDAT are received, the time length of each frame period FP1, FP2, FP3, FP4 and FP5 may be gradually decreased from the first frame period FP1 corresponding to fifteen emission periods EP to the fifth frame period FP5 corresponding to four emission periods EP, and thus the frame frequency in each frame period FP1, FP2, FP3, FP4 and FP5 may be gradually increased.

In some embodiments, in a case where the product of the emission period EP and the increasing step parameter in the current frame period subtracted from the planned frame time of the current frame period is greater than the frame time threshold value represented by the threshold frame parameter P_FR_TH, the planned frame time of the next frame period may be determined as the minimum frame time represented by the minimum frame parameter P_FR_MIN. For example, as illustrated in FIGS. 10 and 11, in a case where a planned frame time of a first frame period FP1 corresponds to a time length of a frame period including eleven emission periods EP in a blank period, and second frame data DT2 are received as the input image data IDAT within the planned frame time of the first frame period FP1, a finished frame time of the first frame period FP1 may correspond to a time length of a frame period having seven emission periods EP in the blank period. In this case, since the number of the emission periods EP in the blank period corresponding the finished frame time of the first frame period FP1, or seven is greater than the threshold frame parameter P_FR_TH, or six, a planned frame time of a second frame period FP2 may be determined as the minimum frame time represented by the minimum frame parameter P_FR_MIN. Thus, a frame frequency of the second frame period FP2 may be a maximum frame frequency corresponding to the minimum frame time. Further, in a case where third, fourth, fifth and sixth frame data DT3, DT4, DT5 and DT6 are received in second, third, fourth and fifth frame periods FP2, FP3, FP4 and FP5, respectively, the panel driver 120 may provide third, fourth, fifth and sixth data voltages VDAT3, VDAT4, VDAT5 and VDAT6 corresponding to the third, fourth, fifth and sixth frame data DT3, DT4, DT5 and DT6 at the maximum frame frequency in third, fourth, fifth and sixth frame periods FP3, FP4, FP5 and FP6.

Referring again to FIGS. 1 and 5, if the operation mode of the OLED display device 100 is the gaming mode (S410: YES), the panel driver 120 may determine a planned frame time of each frame period as a maximum frame time (S470), may finish a current frame period when the input image data IDAT are received (S475), may determine a parameter set of a next frame period based on a finished frame time of the current frame period (S480), and may drive the display panel 110 based on the determined parameter set in the next frame period (S490).

For example, in the gaming mode, the panel driver 120 storing parameter sets P_SET1, P_SET2, P_SET3 and P_SET4 of FIG. 12 may drive the display panel 110 as illustrated in FIG. 13. Since the minimum frame parameter P_FR_MIN in FIG. 12 represents one emission period EP in a blank period, a time of each frame period FP1, FP2, FP3, FP4, FP5 and FP6 may be longer than or equal to a frame period having one emission period EP in the blank period, and a first pulse of the tearing effect signal TE in each frame period FP1, FP2, FP3, FP4, FP5 and FP6 are expressed as a dotted line in FIG. 13. The panel driver 120 may determine a planned frame time of each frame period FP1, FP2, FP3, FP4, FP5 and FP6 as the maximum frame time represented by the maximum frame parameter P_FR_MAX. Thus, in a case where the input image data IDAT are not received, each frame period FP1, FP2, FP3, FP4, FP5 and FP6 may continue until the emission period EP is repeated sixteen times in the blank period. Further, as illustrated in FIG. 13, each frame period FP1, FP2, FP3, FP4, FP5 and FP6 may be finished when the input image data IDAT are received. Thus, in the gaming mode, while each frame period FP1, FP2, FP3, FP4, FP5 and FP6 of the display panel 110 is maintained as an integer multiple of the emission period EP, the frame frequency of the display panel 110 may be determined by the frame frequency of the input image data IDAT.

Further, in the gaming mode, the parameter set of the next frame period may be determined based on the finished frame time of the current frame period (or based on the number of the emission periods EP in the blank period of the finished current frame period). For example, since the number of the emission periods EP in the blank period of the first frame period FP1 is four greater than the first range parameter P_RANGE_LIMIT1 and less than or equal to the second range parameter P_RANGE_LIMIT2, a parameter set of the second frame period FP2 may be determined as the second parameter set P_SET2. Further, since the number of the emission periods EP in the blank period of the second frame period FP2 is one less than or equal to the first range parameter P_RANGE_LIMIT1, a parameter set of the third frame period FP3 may be determined as the first parameter set P_SET1. Further, since the number of the emission periods EP in the blank period of the third frame period FP3 is ten greater than the second range parameter P_RANGE_LIMIT2 and less than or equal to the third range parameter P_RANGE_LIMIT3, a parameter set of the fourth frame period FP4 may be determined as the third parameter set P_SET3. Further, since the number of the emission periods EP in the blank period of the fourth frame period FP4 is four greater than the first range parameter P_RANGE_LIMIT1 and less than or equal to the second range parameter P_RANGE_LIMIT2, a parameter set of the fifth frame period FP5 may be determined as the second parameter set P_SET2. Further, since the number of the emission periods EP in the blank period of the fifth frame period FP5 is fifteen greater than the third range parameter P_RANGE_LIMIT3, a parameter set of the sixth frame period FP6 may be determined as the fourth parameter set P_SET4.

As described above, in the method of operating the OLED display device 100 according to embodiments, the panel driver 120 may drive the display panel 110 at the frame frequency corresponding to 1/N of the emission frequency such that each frame period corresponds to the N multiple of the emission period. Accordingly, even if the input image data IDAT are received at a variable frame rate (or a variable frame frequency), the emission duty ratio in each frame period may be maintained as substantially constant, and the flicker may be prevented from occurring. Further, in the method of operating the OLED display device 100 according to embodiments, the panel driver 120 may gradually decrease the frame frequency of the display panel 110 in the case where the input image data IDAT are not received and may gradually increase the frame frequency of the display panel 110 in the case where the input image data IDAT are received. Accordingly, even if the frame rate (or the frame frequency) of the input image data IDAT is rapidly changed, a luminance change caused by the change of the frame frequency may not be perceived by the user.

Figure 14:
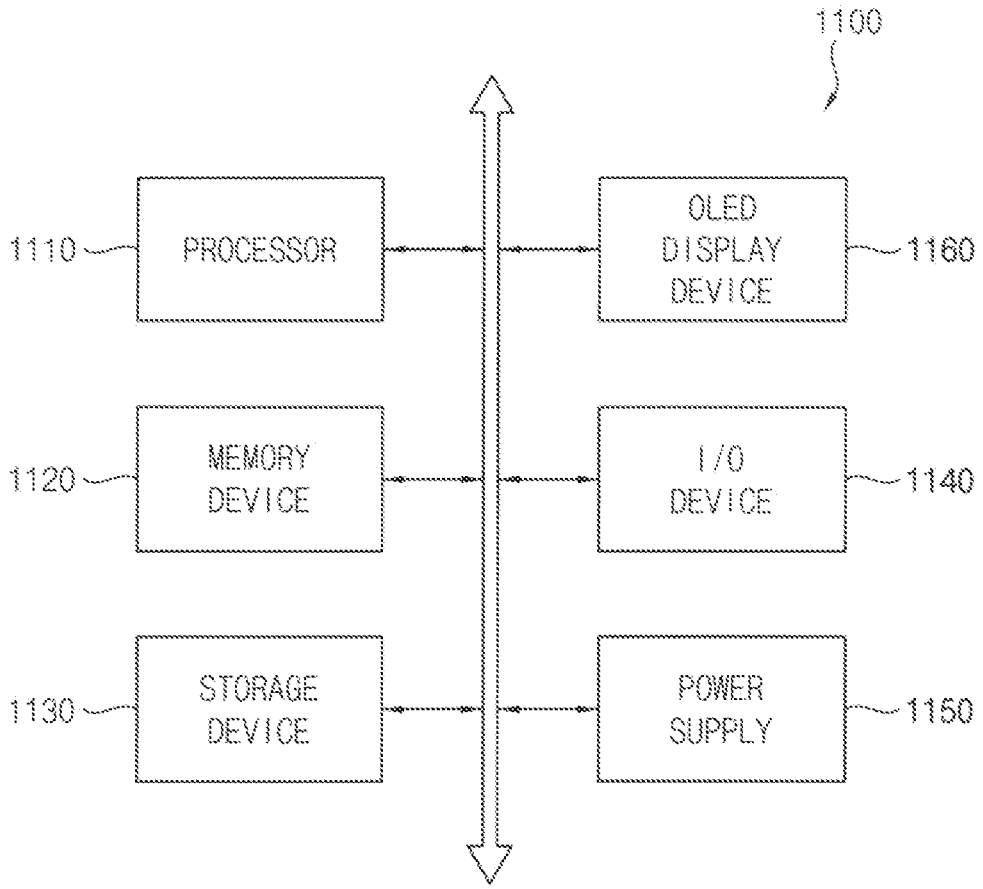
FIG. 14 is a block diagram illustrating an electronic device including an OLED display device according to embodiments.

FIG. 14 is a block diagram illustrating an electronic device including an OLED display device according to embodiments.

Referring to FIG. 14, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electronic devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The OLED display device 1160 may be coupled to other components through the buses or other communication links.

In the OLED display device 1160, a display panel may be driven at a frame frequency corresponding to 1/N of an emission frequency such that each frame period corresponds to an N multiple of an emission period. Accordingly, even if input image data are received at a variable frame rate (or a variable frame frequency), an emission duty ratio in each frame period may be maintained as substantially constant, and a flicker may be prevented from occurring. Further, in the OLED display device 1160, a frame frequency of the display panel may be gradually decreased in a case where the input image data are not received, and the frame frequency of the display panel may be gradually increased in a case where the input image data are received. Accordingly, even if a frame rate (or a frame frequency) of the input image data is rapidly changed, a luminance change caused by the change of the frame frequency may not be perceived by a user.

The inventive concepts may be applied to any OLED display device 1160 supporting an adaptive sync mode, and any electronic device 1100 including the OLED display device 1160. For example, the inventive concepts may be applied to a smart phone, a wearable electronic device, a tablet computer, a mobile phone, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing embodiments are not to be construed as limiting the present inventive concepts. Those skilled in the art will appreciate that many modifications are possible without materially departing from the novel teachings and advantages of the present inventive concepts. Accordingly, the scope of the invention is defined by the appended claims.

What is claimed is:

1. An organic light emitting diode (OLED) display device comprising:

a display panel including a plurality of pixels; and a panel driver configured to drive the display panel, wherein the panel driver is further configured to:

drive the display panel at a frame frequency corresponding to 1/N of an emission frequency such that each frame period corresponds to an N multiple of an emission period, where N is an integer greater than 1;

gradually decrease the frame frequency of the display panel in a case where input image data is not received; and gradually increase the frame frequency of the display panel in a case where the input image data is received.

2. The OLED display device of claim 1, wherein the panel driver gradually increases a number of emission periods within the frame period in the case where the input image data is not received, and wherein the panel driver gradually decreases the number of emission periods within the frame period in the case where the input image data is received.

3. The OLED display device of claim 1, wherein the panel driver increases a planned frame time of a next frame period by M emission periods than a planned frame time of a current frame period in the case where the input image data is not received during the planned frame time of the current frame period, where M is an integer greater than 0, and wherein the panel driver decreases the planned frame time of the next frame period by K emission periods than the planned frame time of the current frame period in the case where the input image data is received during the planned frame time of the current frame period, where K is an integer greater than 0.

4. The OLED display device of claim 1, wherein, when the frame frequency of the display panel is changed, the panel driver changes a gamma set for generating data voltages provided to the plurality of pixels.

5. The OLED display device of claim 1, wherein the panel driver determines a planned frame time of a next frame period based on a planned frame time of a current frame period and whether the input image data is received in the current frame period, and wherein the panel driver determines a parameter set in the next frame period based on the planned frame time of the next frame period.

6. The OLED display device of claim 5, wherein the panel driver stores a plurality of parameter sets respectively corresponding to a plurality of frame time ranges, and wherein each of the plurality of parameter sets includes:

a gamma set representing gamma reference voltages for generating data voltages provided to the plurality of pixels;

a decreasing step parameter representing a number of emission periods within the frame period to be increased when the frame frequency is decreased;

an increasing step parameter representing a number of emission periods within the frame period to be decreased when the frame frequency is increased;

a decreasing hold frame parameter representing a number of frame periods having a decreased frame frequency when the frame frequency is decreased; and an increasing hold frame parameter representing a number of frame periods having an increased frame frequency when the frame frequency is increased.

7. The OLED display device of claim 6, wherein, in the case where the input image data is not received in the current frame period, the current frame period is finished when a time of the current frame period becomes the planned frame time of the current frame period, the planned frame time of the next frame period is calculated by adding a product of the emission period and the decreasing step parameter in the current frame period to the planned frame time of the current frame period, and the parameter set of the next frame period is determined as one of the plurality of parameter sets corresponding to the planned frame time of the next frame period.

8. The OLED display device of claim 7, wherein the panel driver further stores a maximum frame parameter corresponding to a maximum frame time, and wherein the planned frame time of the next frame period is determined as the maximum frame time in a case where the product of the emission period and the decreasing step parameter in the current frame period added to the planned frame time of the current frame period is greater than the maximum frame time.

9. The OLED display device of claim 6, wherein, in the case where the input image data is received in the current frame period, a finished frame time of the current frame period is calculated by subtracting a product of the emission period and the increasing step parameter in the current frame period from the planned frame time of the current frame period, the current frame period is finished when a time of the current frame period becomes the finished frame time of the current frame period, the planned frame time of the next frame period is determined as the finished frame time of the current frame period, and the parameter set of the next frame period is determined as one of the plurality of parameter sets corresponding to the planned frame time of the next frame period.

10. The OLED display device of claim 9, wherein the panel driver further stores a minimum frame parameter corresponding to a minimum frame time, and wherein the planned frame time of the next frame period is determined as the minimum frame time in a case where the product of the emission period and the increasing step parameter in the current frame period subtracted from the planned frame time of the current frame period is less than the minimum frame time.

11. The OLED display device of claim 10, wherein the panel driver further stores a threshold frame parameter corresponding to a frame time threshold value, and wherein the planned frame time of the next frame period is determined as the minimum frame time in a case where the product of the emission period and the increasing step parameter in the current frame period subtracted from the planned frame time of the current frame period is greater than the frame time threshold value.

12. The OLED display device of claim 1, wherein the panel driver stores a gaming mode parameter representing whether an operation mode is a gaming mode, and a maximum frame parameter corresponding to a maximum frame time, and wherein, in a case where the gaming mode parameter indicates the gaming mode, a planned frame time of each frame period is determined as the maximum frame time, a current frame period is finished when the input image data is received, and a parameter set of a next frame period is determined based on a finished frame time of the current frame period.

13. A method of operating an organic light emitting diode (OLED) display device, the method comprising:

driving a display panel of the OLED display device at a frame frequency corresponding to 1/N of an emission frequency such that each frame period corresponds to an N multiple of an emission period, where N is an integer greater than 1;

gradually decreasing the frame frequency of the display panel in a case where input image data is not received; and gradually increasing the frame frequency of the display panel in a case where the input image data is received.

14. The method of claim 13, wherein gradually decreasing the frame frequency of the display panel includes:

gradually increasing a number of the emission periods within frame period in the case where the input image data is not received, and wherein gradually increasing the frame frequency of the display panel includes:

gradually decreasing the number of emission periods within the frame period in the case where the input image data is received.

15. The method of claim 13, wherein gradually decreasing the frame frequency of the display panel includes:

increasing a planned frame time of a next frame period by M emission periods than a planned frame time of a current frame period in the case where the input image data is not received during the planned frame time of the current frame period, where M is an integer greater than 0, and wherein gradually increasing the frame frequency of the display panel includes:

decreasing the planned frame time of the next frame period by K emission periods than the planned frame time of the current frame period in the case where the input image data is received during the planned frame time of the current frame period, where K is an integer greater than 0.

16. The method of claim 13, further comprising:

changing a gamma set for generating data voltages provided to a plurality of pixels of the display panel when the frame frequency of the display panel is changed.

17. The method of claim 13, wherein gradually decreasing the frame frequency of the display panel includes:

finishing a current frame period when a time of the current frame period becomes a planned frame time of the current frame period in the case where the input image data is not received in the current frame period;

calculating a planned frame time of a next frame period by adding a product of the emission period and a decreasing step parameter in the current frame period to the planned frame time of the current frame period; and determining a parameter set of the next frame period based on the planned frame time of the next frame period.

18. The method of claim 13 wherein gradually increasing the frame frequency of the display panel includes:

calculating a finished frame time of a current frame period by subtracting a product of the emission period and an increasing step parameter in the current frame period from a planned frame time of the current frame period in the case where the input image data is received in the current frame period;

finishing the current frame period when a time of the current frame period becomes the finished frame time of the current frame period;

determining a planned frame time of a next frame period as the finished frame time of the current frame period; and determining a parameter set of the next frame period based on the planned frame time of the next frame period.

19. The method of claim 18, wherein determining the planned frame time of the next frame period includes:

determining the planned frame time of the next frame period as the finished frame time of the current frame period in a case where the product of the emission period and the increasing step parameter in the current frame period subtracted from the planned frame time of the current frame period is less than or equal to a frame time threshold value; and determining the planned frame time of the next frame period as a minimum frame time in a case where the product of the emission period and the increasing step parameter in the current frame period subtracted from the planned frame time of the current frame period is greater than the frame time threshold value.

20. The method of claim 13, further comprising:

determining whether a gaming mode parameter indicates a gaming mode;

determining a planned frame time of each frame period as a maximum frame time in a case where the gaming mode parameter indicates the gaming mode;

finishing a current frame period when the input image data is received; and determining a parameter set of a next frame period based on a finished frame time of the current frame period.

* * * * *